US010151490B1

(12) United States Patent
Wolf

(10) Patent No.: US 10,151,490 B1
(45) Date of Patent: Dec. 11, 2018

(54) PORTABLE FIRE PIT

(71) Applicant: Mark Andrew Wolf, Surprise, AZ (US)

(72) Inventor: Mark Andrew Wolf, Surprise, AZ (US)

( * ) Notice: Subject to any disclaimer, the term of this patent is extended or adjusted under 35 U.S.C. 154(b) by 0 days.

(21) Appl. No.: 15/928,424

(22) Filed: Mar. 22, 2018

Related U.S. Application Data

(60) Provisional application No. 62/619,263, filed on Jan. 19, 2018.

(51) Int. Cl.
*F24B 13/02* (2006.01)
*F24B 1/18* (2006.01)

(52) U.S. Cl.
CPC ..... *F24B 1/1808* (2013.01)

(58) Field of Classification Search
CPC .... F24C 1/16; F24C 3/00; F24C 15/06; F24C 15/10; F24C 3/022; F24C 3/027; F24C 3/08; F24C 7/004; A47J 37/0763; A47J 33/00; A47J 2037/0777; A47J 37/0704; A47J 37/07; A47J 37/0786; A47J 2037/0795; A47J 37/00; A47J 37/0731; A47J 37/0772; A47J 37/0781; A47J 27/00; A47J 37/041; A47J 37/071; A47J 37/079; A47J 2201/00; A47J 27/002; A47J 36/00; A47J 36/02; A47J 36/38; A47J 37/04; A47J 37/043; A47J 37/0611; A47J 37/0623; A47J 37/0658; A47J 37/0688; A47J 37/0718
See application file for complete search history.

(56) References Cited

U.S. PATENT DOCUMENTS

| | | | |
|---|---|---|---|
| 73,922 | A | 1/1868 | Philbrick |
| 585,001 | A | 6/1897 | MacDonald |
| 2,590,903 | A | 4/1952 | Stretz |
| 2,720,269 | A | 10/1955 | Diacos |
| 2,933,378 | A | 4/1960 | Mustin et al. |
| 3,028,228 | A | 4/1962 | Chaplin |
| 3,105,483 | A | 10/1963 | Bryan |
| 3,279,900 | A | 10/1966 | Naples |
| 3,490,433 | A | 1/1970 | Busenbarrick |

(Continued)

FOREIGN PATENT DOCUMENTS

| | | |
|---|---|---|
| CN | 201567838 | 9/2010 |
| CN | 10282559 A | 1/2013 |

(Continued)

OTHER PUBLICATIONS

Arnoldi english translation.*

(Continued)

*Primary Examiner* — Jason Lau
(74) *Attorney, Agent, or Firm* — Knobbe Martens Olson & Bear, LLP

(57) ABSTRACT

A portable fire pit is provided that includes a frame, a support structure, and a mesh. The frame can include a plurality of upwardly extending rods and cross-bars extending between the upwardly extending rods. The support structure can include a plurality of supports having an upper wall, a base, and an aperture sized to receive an upwardly extending rod of the frame. The support structure can extend around a periphery of the frame. The mesh can include a base and a plurality of apertures sized to receive an upwardly extending rod of the frame.

18 Claims, 17 Drawing Sheets

(56) References Cited

U.S. PATENT DOCUMENTS

| | | | | |
|---|---|---|---|---|
| 3,491,743 | A | 1/1970 | Temp | |
| 3,606,066 | A | 9/1971 | Anderson | |
| 3,782,475 | A | 1/1974 | Schmidt | |
| 3,841,298 | A | 10/1974 | Sellors | |
| 4,434,784 | A | 3/1984 | Van Patten | |
| 4,478,601 | A | 10/1984 | Stephens | |
| 4,508,094 | A | 4/1985 | Hait | |
| 4,635,612 | A | 1/1987 | Kakubari et al. | |
| 4,658,906 | A | 4/1987 | Hanten | |
| 4,719,935 | A | 1/1988 | Gustafson | |
| 4,751,911 | A | 6/1988 | Betts et al. | |
| 4,759,276 | A | 7/1988 | Segroves | |
| 4,829,975 | A * | 5/1989 | Hait | A47J 37/0763 126/152 B |
| 4,832,703 | A | 5/1989 | Campana et al. | |
| 5,105,725 | A | 4/1992 | Haglund | |
| 5,253,634 | A | 10/1993 | LeBouf | |
| 5,766,275 | A | 6/1998 | Chandaria | |
| 5,809,989 | A | 9/1998 | Nelson | |
| 5,984,406 | A * | 11/1999 | Lee | A47C 4/286 297/16.2 |
| 6,074,446 | A | 6/2000 | Fujino | |
| 6,101,931 | A | 8/2000 | Miklos | |
| 6,131,560 | A * | 10/2000 | Healy | A47J 37/0763 126/30 |
| 6,173,644 | B1 | 1/2001 | Krall | |
| 6,254,265 | B1 | 7/2001 | MacDonald | |
| 6,349,713 | B1 | 2/2002 | Toyama | |
| 6,467,474 | B2 | 10/2002 | Hermansen et al. | |
| 6,918,387 | B2 | 7/2005 | Klarich et al. | |
| 6,962,148 | B1 | 11/2005 | Ashbaugh | |
| 7,644,711 | B2 | 1/2010 | Creel | |
| 8,216,322 | B2 | 7/2012 | Schweickhardt | |
| 8,327,834 | B1 | 12/2012 | Judge | |
| 8,584,580 | B2 | 11/2013 | Barrett | |
| 2003/0029443 | A1 | 2/2003 | Davis et al. | |
| 2003/0140577 | A1 | 7/2003 | Cote | |
| 2003/0145845 | A1 | 8/2003 | Brocking | |
| 2004/0262018 | A1 | 12/2004 | Roussin | |
| 2006/0102169 | A1 | 5/2006 | Smolinsky | |
| 2006/0225725 | A1 | 10/2006 | Rinaldo | |
| 2009/0194297 | A1 | 8/2009 | Teruel | |
| 2011/0162634 | A1 | 7/2011 | Richard | |
| 2011/0209738 | A1 | 9/2011 | McCarty | |
| 2012/0125323 | A1 * | 5/2012 | Goeken | A47J 37/0704 126/9 R |
| 2012/0152962 | A1 | 6/2012 | Arbuckle | |
| 2012/0318255 | A1 | 12/2012 | Brown | |
| 2013/0298895 | A1 | 11/2013 | Robb | |
| 2014/0069411 | A1 | 3/2014 | Huang | |
| 2015/0004297 | A1 | 1/2015 | Pothetes | |
| 2016/0029566 | A1 | 2/2016 | Gaudet | |
| 2016/0033160 | A1 | 2/2016 | Gaudet et al. | |
| 2016/0338535 | A1 | 11/2016 | Witsch | |
| 2017/0081607 | A1 | 3/2017 | Schunk | |
| 2017/0276343 | A1 | 9/2017 | Wolf | |
| 2017/0276371 | A1 | 9/2017 | Wolf | |

FOREIGN PATENT DOCUMENTS

| | | | | |
|---|---|---|---|---|
| DE | 20 2015 105 251 U1 | 11/2015 | | |
| EP | 2933564 A1 * | 10/2015 | | F24C 1/16 |

OTHER PUBLICATIONS

Erfpunt; firewatch; erfpunt.be; downloaded on Aug. 29, 2017 from http://www.erfpunt.be/np/page.pphp?id=487&title=vuuklok.

Fire Blanket Demonstration, "Fire Away Fire Blanket", Jan. 20, 2011, Youtube.com.

The Historic Foodie; Couere-feu, The Practice of Preserving Fire; Nov. 2, 2011; thehistoricfoodie.wordpress.com; https://thehistoricfoodie.wordpress.com/2011/11/02/couere-fue-the-practice-of-preserving-fire%C2%A9/.

Laplander1, Frisport Andersnatten Extreme 6-8 Person Lavvu, Laplander's Natural Lore Blog, available at: https://naturallore.wordpress.com/2011/08/31/frisport-andersnatten-extreme-6-8-person-lavvu/, dated Aug. 31, 2011.

Memory of the Netherlands; Fire bell; gehugenvannederland.nl; downloaded on Aug. 29, 2017 from http://www.geheugenvannederland.nl/nl/geheugen/view?coll=ngvn&identifier=ZZM01%3A011323.

objectlessons.com, Curfew, Fire Cover, Medieval, Replica webpage, downloaded on Jun. 13, 2017 from https://www.objectlessons.org/houses-and-homes-medieval/curfew-fire-cover-medieval-replica/s61/a245/.

podpads.com, Bell Tent, downloaded on Feb. 24, 2016 http://podpads.com/bell-tent.

Portable Outdoor Fire Pit : Collapsing Steel Mesh FirePlace—Perfect for Camping, Backyard and Garden—Carrying Bag Included; downloaded on Jan. 2, 2018 from https://www.amazon.com/Portable-Outdoor-Fire-Pit-Collapsing/dp/B01NBU7XLH/ref=sr_; in 4 pages.

weber.com, Original Kettle Series, downloaded on Jun. 13, 2017 from https://www.weber.com/US/en/grills/original-kettle-charcoal-grill.

Welding-Blankets.com; downloaded on Dec. 1, 2009 from http://www.welding-blankets.com.

Werkgroep Archelogie Hulst; Veiligheid in huis; archeologiehulst.nl; downloaded on Aug. 29, 2017 from http://www.archeologiehulst.np/pagina33.html.

Venetian Cat Studio; Medieval, Todor, Renaissance, Colonial; Feb. 28, 2016; venetiancat.com; http://venetiancat.com/CookwareAncientP2.html.

* cited by examiner

PORTABLE FIRE PIT

CROSS-REFERENCE TO RELATED APPLICATIONS

This application claims priority to U.S. Provisional Application No. 62/619,263, filed Jan. 19, 2018, the entirety of which is incorporated herein by reference.

BACKGROUND

Field

Certain embodiments described herein relate generally to fire equipment.

Background

In some campgrounds or other venues, a fire region exists as a designated spot to build and light a fire. These fire regions may include a fire ring which reduces the likelihood of embers escaping from the fire region. However, in some types of campgrounds or other venues, such as those typically frequented by backpackers, hikers, beach-goers, or river rafters, such fire regions do not exist. Moreover, sometimes people utilizing these types of campgrounds or other venues are required to bring their own supplies for containing a fire.

SUMMARY

Certain example embodiments are summarized below for illustrative purposes. The embodiments are not limited to the specific implementations recited herein. Embodiments may include several novel features, no single one of which is solely responsible for its desirable attributes or which is essential to the embodiments.

In some embodiments, a fire containment system, such as a fire pit, is lightweight, easily transportable, and easily assembled, and/or a fire containment system can allow a user to easily interchange parts depending on the needs of the user. A portable fire pit may include a frame comprising a plurality of upwardly extending rods, the frame being configured to transition between a collapsed configuration and an expanded configuration; a support structure extending around a periphery of the frame, the support structure comprising a plurality of separable supports, each support having an upper wall, a base, and one or more support apertures each sized to receive at least one of the upwardly extending rods; and a mesh configured to support a fuel source, the mesh comprising a base and one or more mesh apertures each sized to receive at least one of the upwardly extending rods. When the portable fire pit is assembled, the base of the mesh can comprise a support contact portion having a support contact area and an exposed portion having an exposed area larger than the support contact area. The frame, the support structure, and the mesh may each be configured to be stored and transported by a user as separate components and then assembled by a user into the portable fire pit without tools. The exposed portion may be in direct, unimpeded communication with an ambient air and be configured to permit airflow to the fuel source through at least a majority of the exposed portion.

The system of the preceding paragraph can further comprise one or more of the following features: the frame further comprises cross-bars extending between the upwardly extending rods; each of the upwardly extending rods comprises an outer rod and an inner rod, wherein the inner rod is slidably disposed at least partially within the outer rod; the support structure further comprises one or more heat dissipation elements; the heat dissipation elements comprises at least one aperture configured to provide air flow to a fuel source; the heat dissipation elements comprises at least one channel in the upper wall, wherein the at least one channel is configured to increase an external surface area of the upper wall; the mesh comprises a porosity configured to permit airflow to the fuel source and to inhibit particulates from passing through the mesh; each of the one or more mesh apertures of the mesh comprises a grommet; the system further comprising a grill grate; the grill grate comprises one or more mounts configured to couple to the upwardly extending rods; each of the one or more mounts comprises a fastener to couple the mount to the upwardly extending rod; the system further comprising a heat shield configured to resist transfer of heat through the heat shield; the heat shield comprises a plurality of mounting components configured to engage at least a portion of the frame.

The system of the preceding paragraph may be utilized in combination with a sleeve, wherein the portable fire pit is configured to be stored within the sleeve when the portable fire pit is in the collapsed configuration.

The system of the preceding paragraph may be utilized in combination with an ember containment system, wherein the ember containment system is configured to retain a fuel source after use.

In some embodiments, a method of enabling the assembly of a portable fire pit, the method may comprise: providing a frame having a collapsed configuration and an expanded configuration, the frame comprising a plurality of rods; providing a plurality of support structures each comprising one or more support apertures configured to slidably engage with at least one of the plurality of rods to removably couple the support structure to the frame when the frame is in the expanded configuration; and providing a mesh comprising one or more mesh apertures configured to slidably engage at least one of the plurality of rods to removably couple the mesh to the frame when the frame is in the expanded configuration, the mesh being further configured to retain a fuel source, the mesh further comprising a frame contact portion and an exposed base, wherein the exposed base is larger than the frame contact portion. The exposed base may be in direct unimpeded communication with an ambient air, the exposed base being configured to permit airflow to the fuel source through a majority of the exposed base.

The method of the preceding paragraph can further include one or more of the following features: the method further comprising providing a heat shield configured to resist transfer of heat through the heat shield, wherein the heat shield is configured to removably attach to at least a portion of the frame; the method further comprising providing a sleeve configured to store one or more of the frame, the plurality of support structures, and the mesh within the sleeve when the frame is in the collapsed configuration.

The details of one or more embodiments of the subject matter of this specification are set forth in the accompanying drawings and the description below. Other features, aspects, and advantages of the subject matter will become apparent from the description, the drawings, and from the claims.

BRIEF DESCRIPTION OF THE DRAWINGS

Certain embodiments of fire pits, including embodiments of various components of fire pits, will be discussed in detail with reference to the following figures, wherein like reference numerals refer to similar features throughout. These figures are provided for illustrative purposes and the embodiments are not limited to the specific implementations illustrated in the figures. No structure, step, or other feature is essential or required.

DETAILED DESCRIPTION

Figure 1:
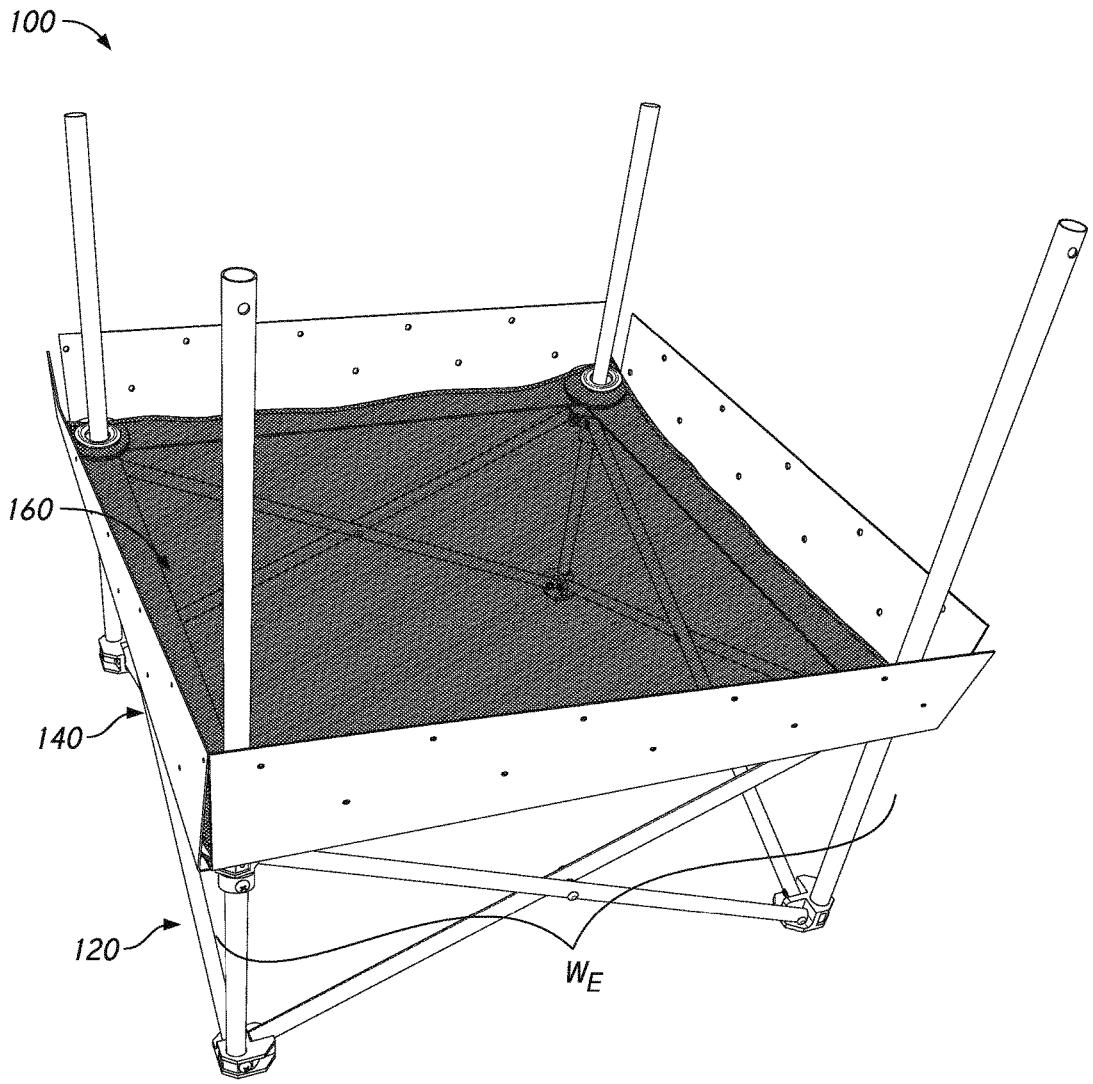
FIG. 1 is a perspective view of an embodiment of a portable fire pit having a frame, a support structure, and a mesh, the fire pit being in an expanded configuration.

The present specification and drawings provide aspects and features of the disclosure in the context of several embodiments of fire containment systems, such as but not limited to portable (e.g., pop-up) fire pits, which can support a fire while camping. Accordingly, the embodiments described herein may be discussed in connection with specific fires and specific situations, such as camping. However, it is to be understood that the features and concepts discussed herein can be applied to other types of fires and situations, such as cooking fires for use on a day outing or in a domicile. In addition, particular features of a fire pit should not be taken as limiting. Moreover, one or more features of any one embodiment discussed herein can be used separately or combined with or used instead of one or more features of any other embodiments.

Certain terminology may be used in the following description for the purpose of reference only, and thus is not intended to be limiting. For example, terms such as "upper", "lower", "upward", "downward", "above", "below", "top", "bottom" and similar terms refer to directions in the drawings to which reference is made. Terms such as "outward", "inward", "outer", "inner", and "side", describe the orientation and/or location of portions of the components or elements within a consistent but arbitrary frame of reference which is made clear by reference to the text and the associated drawings describing the components or elements under discussion. Such terminology may include the words specifically mentioned above, derivatives thereof, and words of similar import. Similarly, the terms "first", "second", and other such numerical terms referring to structures neither imply a sequence or order unless clearly indicated by the context. The relative proportions, lengths, and sizes of components shown in the drawings form part of the supporting disclosure of this application but are not limiting except insofar as expressly set forth in a claim.

Examples of Fire Pits

FIGS. 1-9 are various views of a fire pit, according to various embodiments. In particular, unless otherwise noted, reference numerals in FIGS. 1-9 refer to components that are the same as or generally similar to the components in the remaining figures discussed herein. It will be understood that the portable fire pit 100 shown in FIGS. 1-9, or any components, features, or steps used therein or associate therewith, can be used with any of the embodiments described and/or contemplated herein. It will also be understood that any of the embodiments described and/or contemplated herein can be modified to be used with the portable fire pit 100 shown in FIGS. 1-9.

As shown in FIG. 1, in some embodiments, a portable fire pit 100 can comprise a lower portion and an upper portion. The upper portion can include a fuel support that is configured to support fuel (e.g., a collection of fuel items such as logs, charcoal, wood pieces, etc.) during a burning stage. The fuel support can include a plurality of sides which form a perimeter of the fuel support. The sides of the fuel support can form any shape, such as a rectangle, square, triangle, etc. The lower portion can be configured to elevate the upper portion above a ground surface. For example, in some embodiments, the lower portion can be configured to elevate the upper portion above a ground surface to a level that is: (a) at least about one-third, one-quarter, or one-half of the length of one of the sides of the fuel support; (b) configured to position the center of gravity of the fully assembled portable fire pit 100, with and/or without fuel, at or below about the level of the bottom surface of the upper portion; (c) at least about twice as high as the vertical thickness of the upper portion (the vertical distance between the bottom and top of the upper portion); and/or (d) at least about 8 inches or at least about 15 inches. The lower portion and the upper portion can be separable from each other by a user without the use of tools, and each can comprise a retracted or collapsed position and a deployed or expanded position.

The lower portion can comprise a plurality of rods that are interconnected to form a support structure. Any or all of the rods can be generally cylindrical. In some embodiments, a plurality of peripheral rods (e.g., at least 3 rods or at least 4 rods) can be oriented substantially parallel with each other in both the retracted and the deployed positions of the lower portion. In the deployed position, one or more of the peripheral rods can be oriented substantially vertically along an outer periphery of the lower portion and/or at one or more corners of the deployed lower portion. A plurality of one or more additional rods can extend between the peripheral supporting rods to help orient and/or support the peripheral rods in the substantially vertical orientation of the deployed lower portion. In the deployed position, the lower portion can form a hollow periphery having an empty central region without interior structure, in some embodiments. The periphery of the lower portion can be substantially unobstructed, such that a majority of the peripheral boundary (e.g., at least about 50% or at least about 75%) of the lower portion is open and does not comprise wall structure or any other obstacles, permitting air to freely flow from the outside to the inside of the lower portion.

The upper portion can be configured to removably attach to an upper region of the lower portion. For example, the upper portion can be configured to removably attach to a plurality of the peripheral support rods in an overlapping arrangement (e.g., such that an upper region of the lower portion can overlap with the upper portion or even that the topmost part of the lower portion can extend vertically farther than the topmost part of the upper portion). In some embodiments, the upper portion can comprise a plurality of separable portions, including a plurality of guard portions and a fuel support. The plurality of separable portions can be independently attachable to the lower portion to form the upper portion. The fuel support can comprise a generally planar surface in a fuel-supporting region configured to be generally horizontal with respect to the ground in the deployed configuration of the upper portion. The fuel support can comprise a plurality of openings that are configured to be positioned below the fuel-supporting region and between the upper portion and the lower portion of the fire pit and that are sufficiently large to permit or encourage air to enter from below, moving upwardly within the hollow interior or central region of the lower portion, into the fuel-supporting region of the upper portion for the fire. The openings of the fuel support can be sufficiently small to resist the passage of ash, embers, and/or other debris that is larger than about the size of typical particles of powder and/or sand downwardly from the fuel support into the hollow interior or central region of the lower portion. In some embodiments, the vertical thickness (e.g., the vertical distance from the lowest point to the highest point) of the upper portion can be less than the vertical thickness of the lower portion.

In some embodiments, the fire pit can be configured to safely and securely receive fuel items in the upper portion to a vertical level that is at least as high as the topmost part of the upper portion and/or at least as high at the topmost part of the lower portion. In some embodiments, the fire pit can be configured to safely and securely support fuel in a burning stage such that the flames of fire emanating from the fuel can extend vertically upward from the fire support to a point that is higher than or at least as high as an upper edge of the guard portion of the upper portion, or at least as high as the topmost part of the upper portion, or at least as high as the topmost part of the lower portion. In some embodiments, the fire pit does not include a top cover or enclosure or other substantial upper obstacle in order to permit the fire to extend vertically a substantial distance beyond the upper end of the fire pit.

As illustrated, in some embodiments the outer peripheral lateral boundary of the upper portion is about the same as the outer peripheral lateral boundary of the lower portion. For example, the width and length of the sides or perimeter or peripheral boundary of the fire support in the upper portion can be about the same as the width and length of the sides or perimeter or peripheral boundary of the lower portion. Any or all components of the fire pit can be made of a metal, such as steel or aluminum.

With reference first to FIG. 1, an embodiment of a pop-up fire pit 100 is illustrated. The pop-up fire pit 100 can include a lower portion comprising a collapsible frame 120, and an upper portion comprising a guard portion in the form of support structure 140, and/or a fuel support in the form of a mesh 160. The pop-up fire pit 100 can support fuel for a fire source, such as wood and charcoal, on the mesh 160 which is positioned above the ground surface. In some implementations, the pop-up fire pit 100 can support at least about 200 pounds on the mesh 160. In some embodiments, the pop-up fire pit 100 can weigh at least about 1.5 pounds and/or less than or equal to about 6 pounds. In some instances, the ratio between the weight of the supported fuel and the weight of the pop-up fire pit 100 and can be at least about 30:1 and/or less than or equal to about 140:1; however, it is to be understood that this ratio can be higher or lower as desired. Since backpackers typically work with 35-40 pounds in their packs, the light weight of the pop-up fire pit 100 can be particularly beneficial since it does not take up a significant portion of the backpacker's weight allotment. This can allow the backpacker to carry other goods for hiking or camping, such as food and water, or reduce the overall weight of the backpack for comfort.

In the expanded or deployed configuration, the pop-up fire pit 100 can have a square footprint with a width $W_E$ of at least about 10 inches and/or less than or equal to about 30 inches, at least about 15 inches and/or less than or equal to about 28 inches, of at least about 20 inches and/or less than or equal to about 26 inches, about 22 inches, any sub-ranges within these ranges, or other widths as desired. The width $W_E$ of the pop-up fire pit 100 can enhance stability of the pop-up fire pit 100 and thereby reduce the likelihood of tipping. Stability of the pop-up fire pit 100 can be further enhanced for embodiments with a lower center of gravity. In some embodiments, the pop-up fire pit 100 can provide a fire pit with a usable area of at least about 300 $in^2$ and/or less than or equal to about 700 $in^2$. This can allow a camper to maintain a relatively large campfire.

Figure 2:
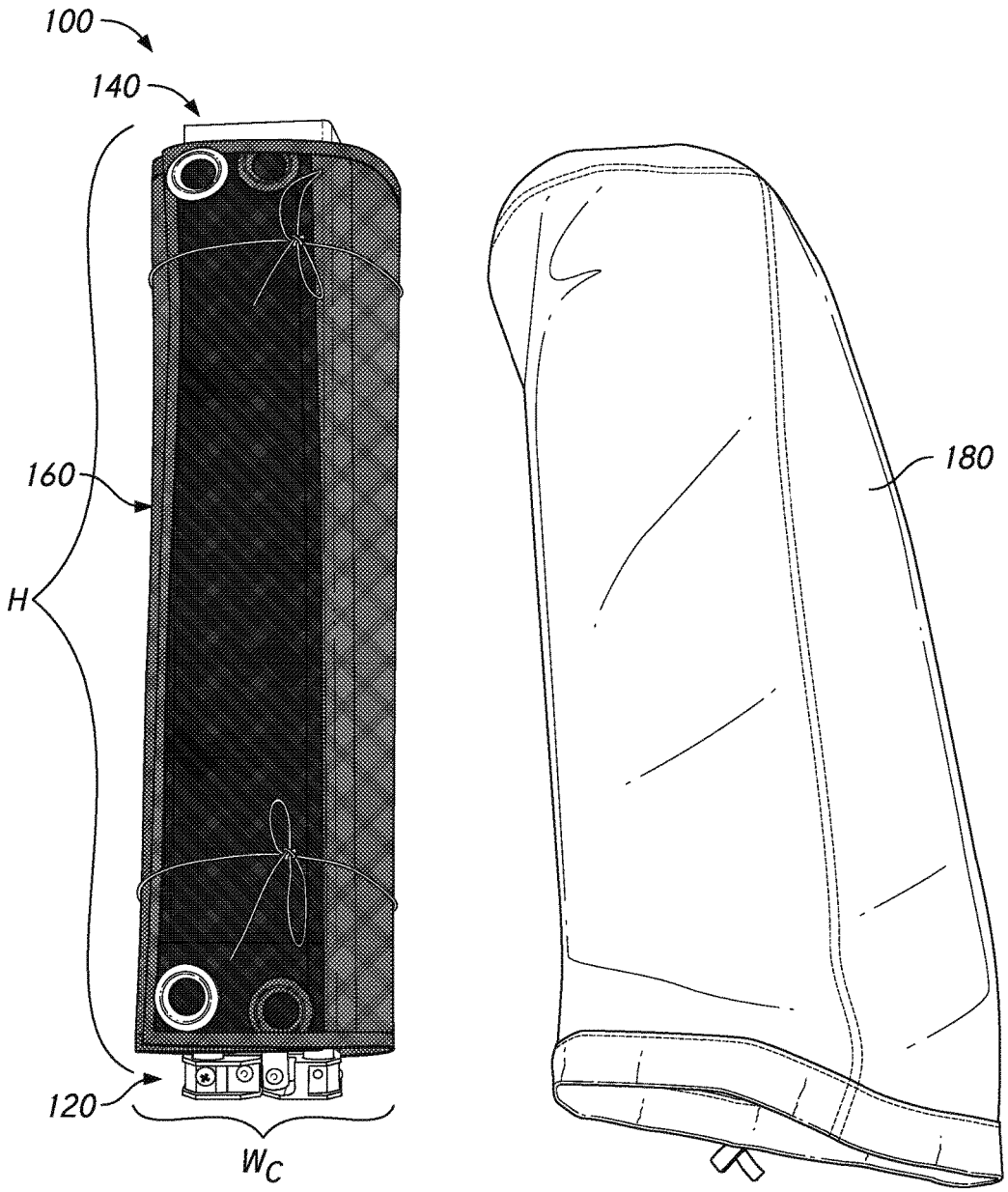
FIG. 2 is a side view of the fire pit of FIG. 1 and a sleeve, the fire pit being in a collapsed configuration.

With reference next to FIG. 2, the pop-up fire pit 100 is illustrated in a collapsed or retracted configuration for storage and transport. The pop-up fire pit 100 can be stored within a sleeve 180 to transport the pop-up fire pit 100. In the collapsed configuration, the pop-up fire pit 100 can have a height H of at least about 18 inches and/or less than or equal to about 30 inches, at least about 20 inches and/or less than or equal to about 28 inches, at least about 22 inches and/or less than or equal to about 26 inches, or about 24 inches, any sub-ranges within these ranges, or other heights as desired. The width $W_C$ of the collapsed pop-up fire pit 100 can be at least about 3 inches and/or less than or equal to about 8 inches, at least about 4 inches and/or less than or equal to about 7 inches, at least about 5 inches and/or less than or equal to about 6 inches, or about 6 inches, any sub-ranges within these ranges, or other widths as desired. The compact form factor or shape of the pop-up fire pit 100 can facilitate carrying and transport of the pop-up fire pit 100 to and from the camping grounds.

Figure 3:
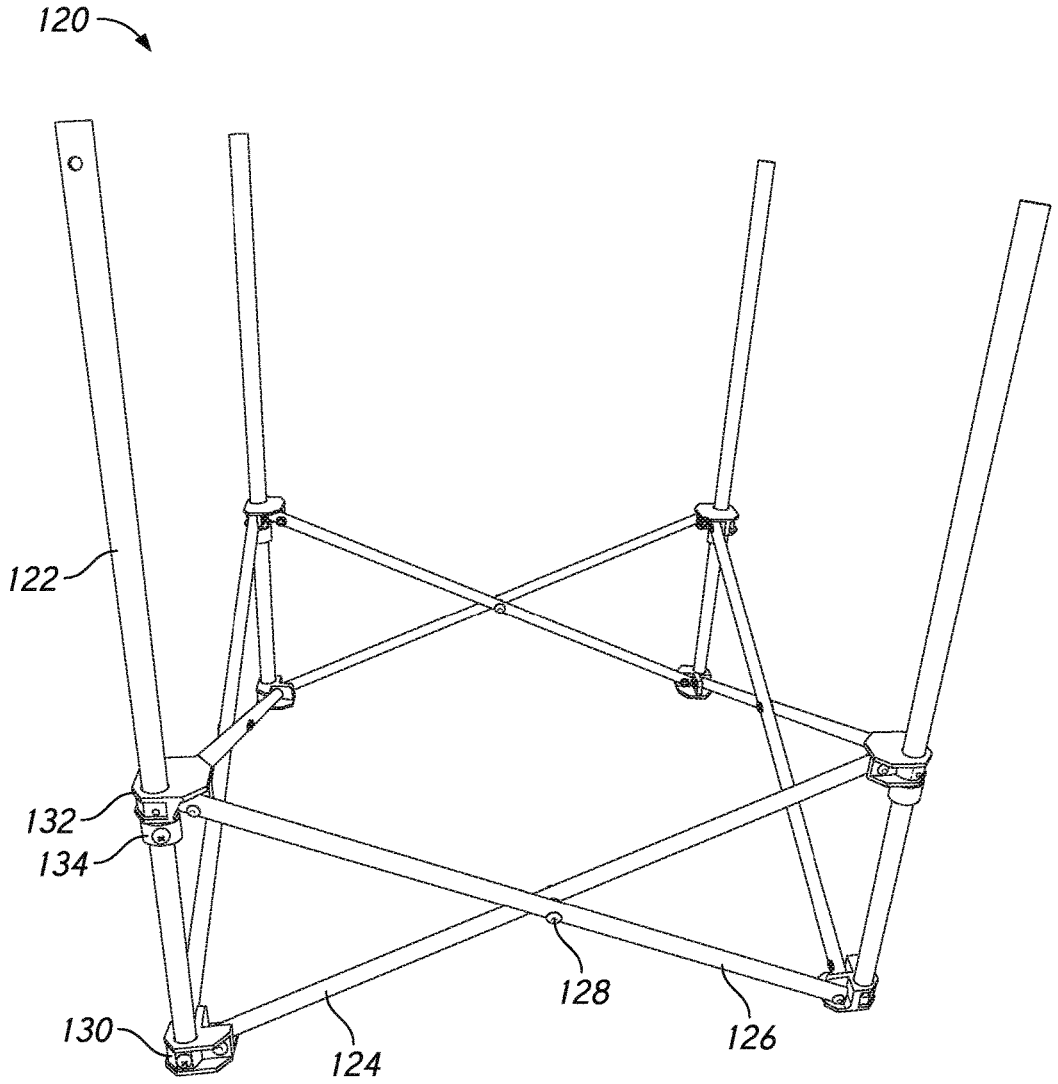
FIG. 3 is a perspective view of the frame of FIG. 1 in an expanded configuration.
Figure 4:
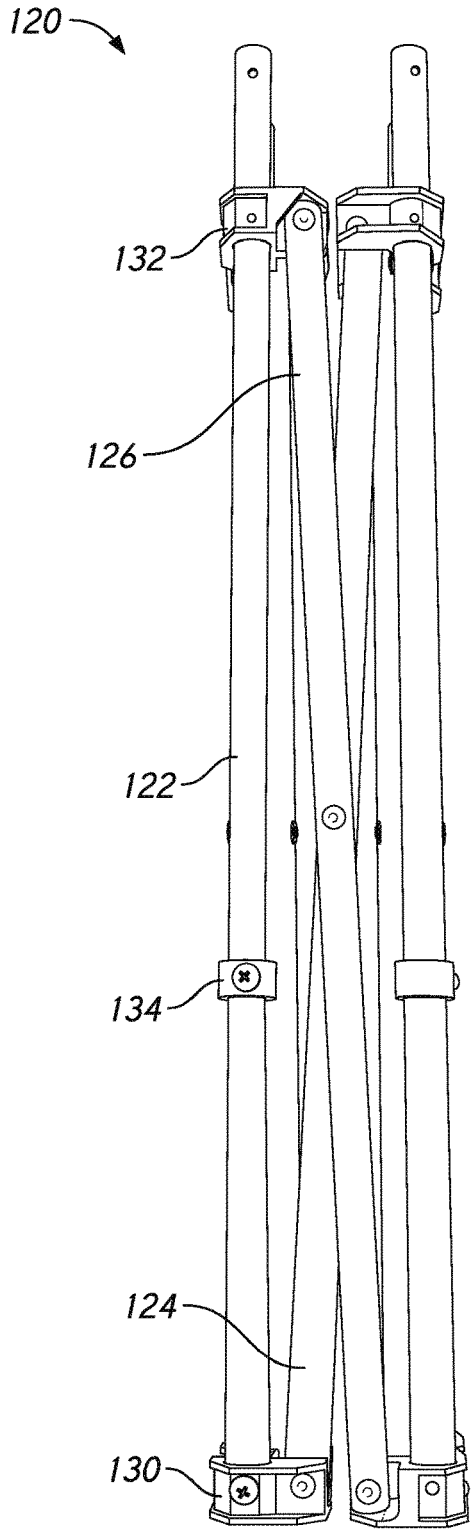
FIG. 4 is a side view of the frame of FIG. 1 in a collapsed configuration.

With reference next to FIGS. 3 and 4, the lower portion or frame 120 of the pop-up fire pit 100 is illustrated in an expanded or deployed configuration (FIG. 3) and a collapsed or retracted configuration (FIG. 4). The frame 120 can include one or more vertical rods 122 and one or more cross-bars 124, 126 extending between the vertical rods 122. As shown, the frame 120 includes four rods 122 with two cross-bars 124, 126 extending between rods 122. The one or more cross-bars can be coupled together via a pivot 128. In some embodiments, the rods 122 and/or the cross-bars 124, 126 can be formed from a metal, such as stainless steel or aluminum; however, it is to be understood that these components can be formed from other types of materials as noted herein. In some embodiments, the rods 122 and/or cross-bars 124, 126 can be coated with a heat-resistant material and/or a thermally insulating material, such as a high heat paint, powder coated, and/or ceramic coated. In some embodiments, the rods 122 and/or cross bars 124, 126 can be anodized. The rods 122 and/or the cross-bars 124, 126 can be hollow to facilitate heat dissipation. For example, in some implementations, the rods 122 and/or the cross-bars 124, 126 can be handled by a person without protective equipment within about 3 to 5 minutes after the pop-up fire pit 100 is used for a campfire. This can facilitate disassembly and disposal of ash and embers shortly after the camper extinguishes the fire.

The rods 122 can include a foot 130 mounted at or proximate a lower end of the rods 122. As shown, one end of each of the cross-bars 124, 126 is rotatably coupled to the foot 130. By mounting the cross-bars 124, 126 to the foot 130, the cross-bars would be mounted near a ground surface thereby enhancing the overall stability of the frame 120. A second end of each of the cross-bars 124, 126 can be rotatably coupled to a mount 132. As shown, the mount 132 can be slideable relative to the rods 122 to allow the second ends of each of the cross-bars 124, 126 to move relative to the rods 122. This can allow the frame 120 to transition between the expanded configuration and the collapsed configuration. The rods 122 can include a stop 134 which limits travel of the mounts 132. The stop 134 can be positioned such that, in the expanded configuration, the mounts 132 are positioned between about 4 to about 6 inches from an upper end of the rods 122. In some embodiments, the foot 130, mount 132, and/or stop 134 can be formed from a metal, such as stainless steel or aluminum, and/or a polymer, such as nylon; however, it is to be understood that these components can be formed from other types of materials as noted herein. Although the mounts 132 are shown sliding vertically along the rods 122, it is to be understood that other configurations can be utilized. For example, the mounts 132 can be positioned on other structures of the frame 120 such as cross-bars 124, 126. The mounts 132 can be oriented such that the slide in a non-vertical direction.

Figure 15:
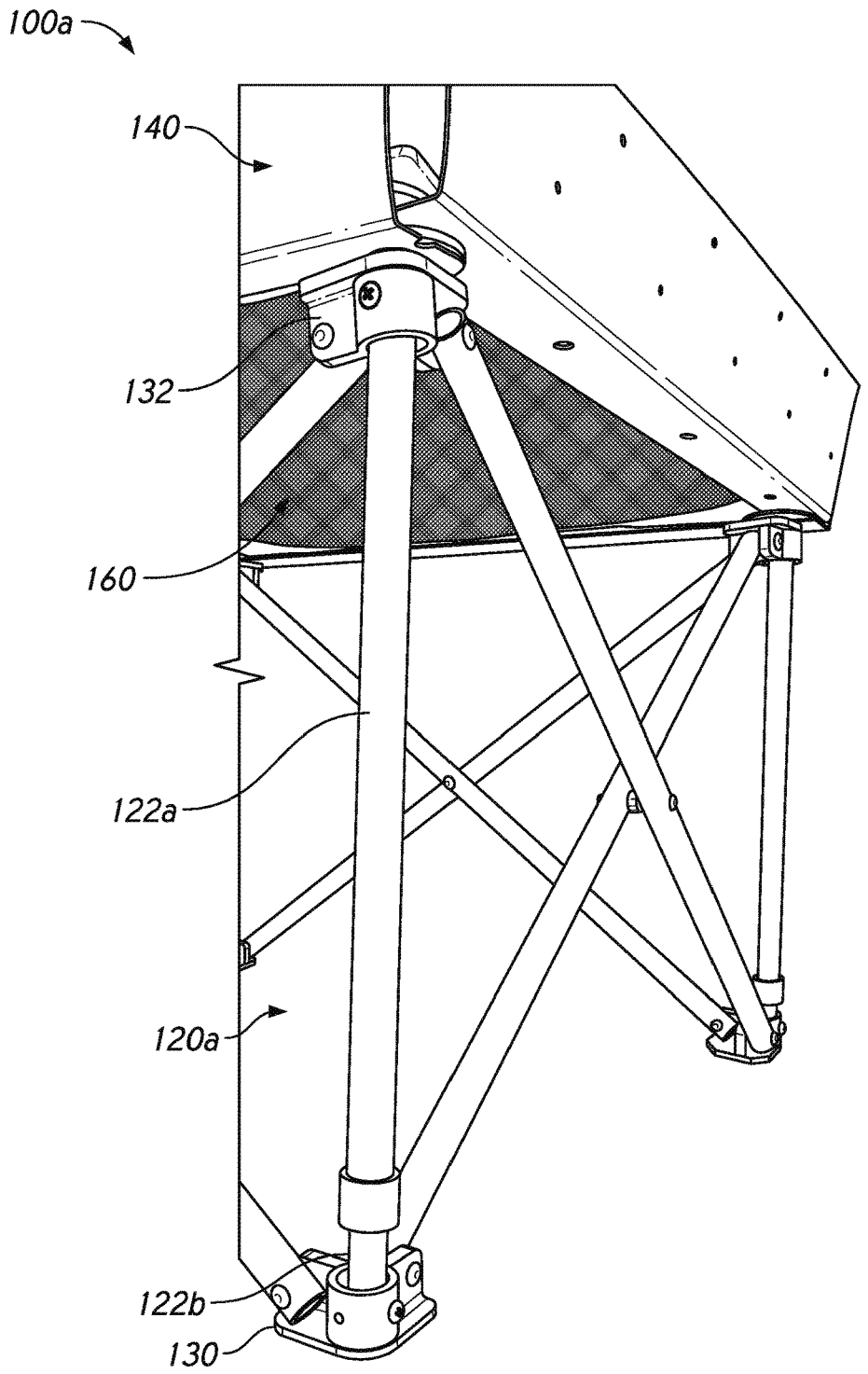
FIG. 15 is a perspective view of an embodiment of a frame having telescoping rods.

Although the rods 122 are shown as having a monolithic structure, it is to be understood that the rods 122 can be formed from two or more separate pieces. In some embodiments, the rods 122 can have a lower component and an upper component which are movable relative to each other. This can beneficially allow a user to reduce the height of the rods 122 when the pop-up fire pit is in the expanded configuration. In some embodiments, the height of the rods 122 can be reduced by about a factor of at least about 1.5 and/or less than or equal to about 2. For example, in some embodiments, the height of the rods 122 can be reduced from between about 24 inches to about 13 inches. As shown in FIG. 15, the pop-up fire pit 100*a* can include a frame 120*a* having an upper or outer rod 122*a* and a lower or inner rod 122*b* in a telescoping arrangement with the outer rod 122*a* slideable over the inner rod 122*b*. Foot 130 can be coupled to the inner rod 122*b* and the mount 132 can be coupled to the outer rod 122*a*. This can allow the foot 130 and mount 132 to move relative to each other and allow the frame 120*a* to transition between collapsed and expanded configurations.

In some embodiments, the outer rod 122*a* and the inner rod 122*b* may comprise an interaction portion configured to provide a snug, tight, telescoping, and/or non-rotating interaction between the rods 122*a*, 122*b*, such as one or more ribs corresponding to one or more slots. For example, an inner surface of the outer rod 122*a* may include one or more ribs configured to engage one or more slots located on an outer surface of the inner rod 122*b*, or vice versa. The one or more ribs of the outer rod 122*a* can be configured to interact with the one or more slot of the inner rod 122*b*, such as to facilitate the attachment to and/or retention between the outer rod 122*a* and the inner rod 1221*b*. For example, in some embodiments, the one or more ribs can be configured to interact with the one or more slots to advantageously prevent or resist the relative rotation between the outer rod 122*a* and the inner rod 122*b*. The term "ribs" referred to herein are structures that are raised or extend outward from a surface. The term "slots" refer to structures that extend below a surface or are positioned between two ribs and are at a lower level than the ribs. The ribs and/or slots can have any suitable form and/or configuration in any devices.

In some embodiments, the one or more ribs and slots can extend along any length between a first end and a second end of the outer rod 122*a* and the inner rod 122*b*, respectively. In certain embodiments, the one or more ribs and slots may extend across the entire length or across the entire or virtually the entire length of the outer rod 122*a* and the inner rod 122*b*, respectively. The size, shape, and/or position of the one or more ribs and slots can be configured to inhibit rotation of the inner rod 122*b* relative to the outer rod 122*a* as the inner rod 122*b* is positioned within and/or is sliding axially along the outer rod 122*a*. In some embodiments, the one or more ribs and slots can comprise any suitable number, such as for example, 1 to 6 or more ribs and slots, although any suitable combination and arrangement can be used. While the one or more ribs and slots are described in the context of the portable fire pit shown in FIG. 15, it will be understood that the one or more ribs and slots may be used with any of the embodiments of a fire pit described and/or contemplated herein.

Figure 5:
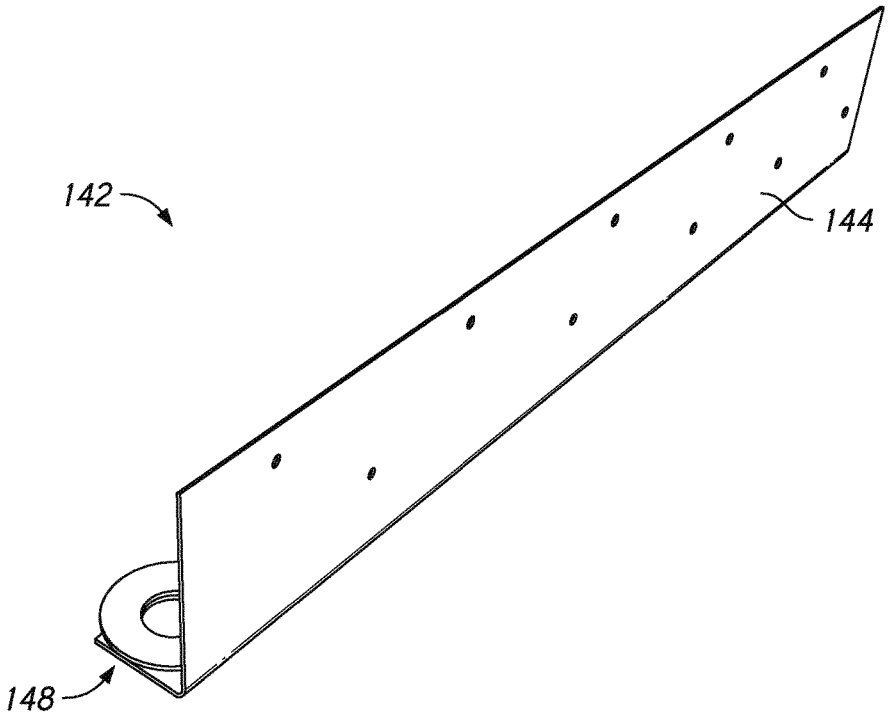
FIG. 5 is a top-oriented perspective view of a support of the support structure of FIG. 1.
Figure 6:
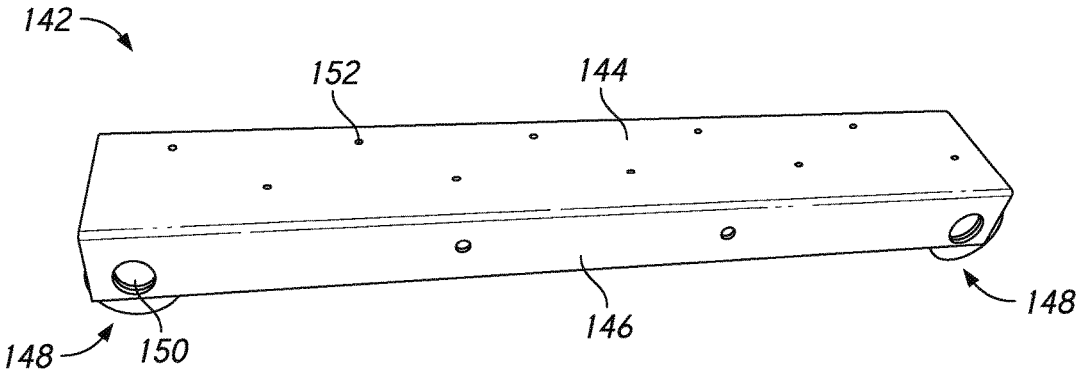
FIG. 6 is a bottom-oriented perspective view of a support of the support structure of FIG. 1.

With reference next to FIGS. 5 and 6, an embodiment of a support 142 forming part of the support structure 140 is illustrated. The support 142 can include an upper wall 144 and a base 146. As shown in the illustrated embodiment, the upper wall 144 can extend generally vertically, and the base 146 can extend generally horizontally in the deployed position of the fire pit. The height of the upper wall 144 can be substantially larger than the width of the base 146, as illustrated. The upper wall 144 can function as a fence or guard which inhibits embers from laterally escaping the pop-up fire pit 100, for example, due to wind or other disturbances. The upper wall 144 can beneficially reflect heat back towards the fire to more efficiently maintain a fire within the pop-up fire pit 100. In some embodiments, the upper wall 144 can be at least about 2 inches and/or less than or equal to about 5 inches, at least about 3 inches and/or less than or equal to about 4 inches, or at least about 3.5 inches, any sub-range within these ranges, or other lengths as desired. The base 146 can extend generally horizontally from the upper wall 144.

The base 146 can include two mounting regions 148 with apertures 150. The spacing between the mounting regions 148 can match or correspond to the spacing of the rods 122 when the frame 120 is in the expanded configuration. In some embodiments, the mounting regions 148 can be reinforced to enhance the structural integrity. The base 146 can support a mesh 160 or other structure placed on the base 146.

This can beneficially increase the amount of weight the mesh 160 or structure can support. In some embodiments, the base 146 can be between about 1 inch to about 4 inches, between about 2 inches to about 3 inches, about 2.5 inches, any sub-range within these ranges, or other lengths as desired. While two mounting regions 148 are shown, it is to be understood that the base 146 can include fewer or greater numbers of mounting regions 148.

The support 142 can comprises one or more elements configured to facilitate heat dissipation from the fuel supporting region when the portable fire pit 100 contains a fire. As identified in the embodiment shown in FIG. 6, in some instances, the heat dissipation elements can comprise one or more small apertures 152 within the support 142. For example, as shown a majority of the support 142 (e.g., at least about 50% or at least about 75% or at least about 90%) may be a solid (e.g., not open or vented) surface, while also including various apertures 152 located throughout the upper wall 144 and/or base 146 of the support 142. The apertures 152 can beneficially increase the rate of heat dissipation and/or provide lateral air flow for the fire. While the one or more apertures 152 are described in the context of the portable fire pit shown in FIG. 6, it will be understood that the one or more apertures 152 may be used with any of the embodiments of a fire pit described and/or contemplated herein.

In some embodiments, the heat dissipation elements of the support 142 can include various surface shapes, textures, and/or treatments to facilitate the transfer of heat from the fuel supporting region. For example, as illustrated in the embodiment shown in FIGS. 19A-19C, the surface shapes, textures, and/or treatments 143 may comprise one or more heat-radiating or heat-dissipating structures such as ribbing, slots, recesses, grooves, channels, and/or protrusions along the upper wall 144 and/or base 146 of the support 146. The surface textures and/or treatments 143 may be configured to provide the support 146 with an increased surface area (e.g., when compared to a support 146 that does not include said surface textures and/or treatment). In some embodiments, the increased surface area can be configured to increase the amount of interface between the support 146 and the surrounding ambient air, thereby increasing heat dissipation. The surface textures and/or treatments 143 may be utilized in combination with or in lieu of apertures 152, discussed herein. The support 142 can be formed from an extruded metal such as aluminum having a thickness of at least about 1 and/or less than or equal to about 3 millimeters. The mounting regions 148 can then be cut from the extruded aluminum, such as via stamping. It is to be understood that the support 142 can be formed via any other methods and/or materials, including any others described herein. While the surface textures and/or treatments 143 are described in the context of the portable fire pit shown in FIGS. 19A-19C, it will be understood that the surface textures and/or treatments 143 may be used with any of the embodiments of a fire pit described and/or contemplated herein.

While the above-referenced figures illustrate embodiments of the heat dissipation elements comprising various features (e.g., apertures and/or surface textures) within the support 142, it is understood that the shape and/or size may vary depending on the number of heat dissipation elements included on the support 146. The size, shape, and/or position of the heat dissipation elements can be configured to facilitate the dissipation of heat.

Figure 7:
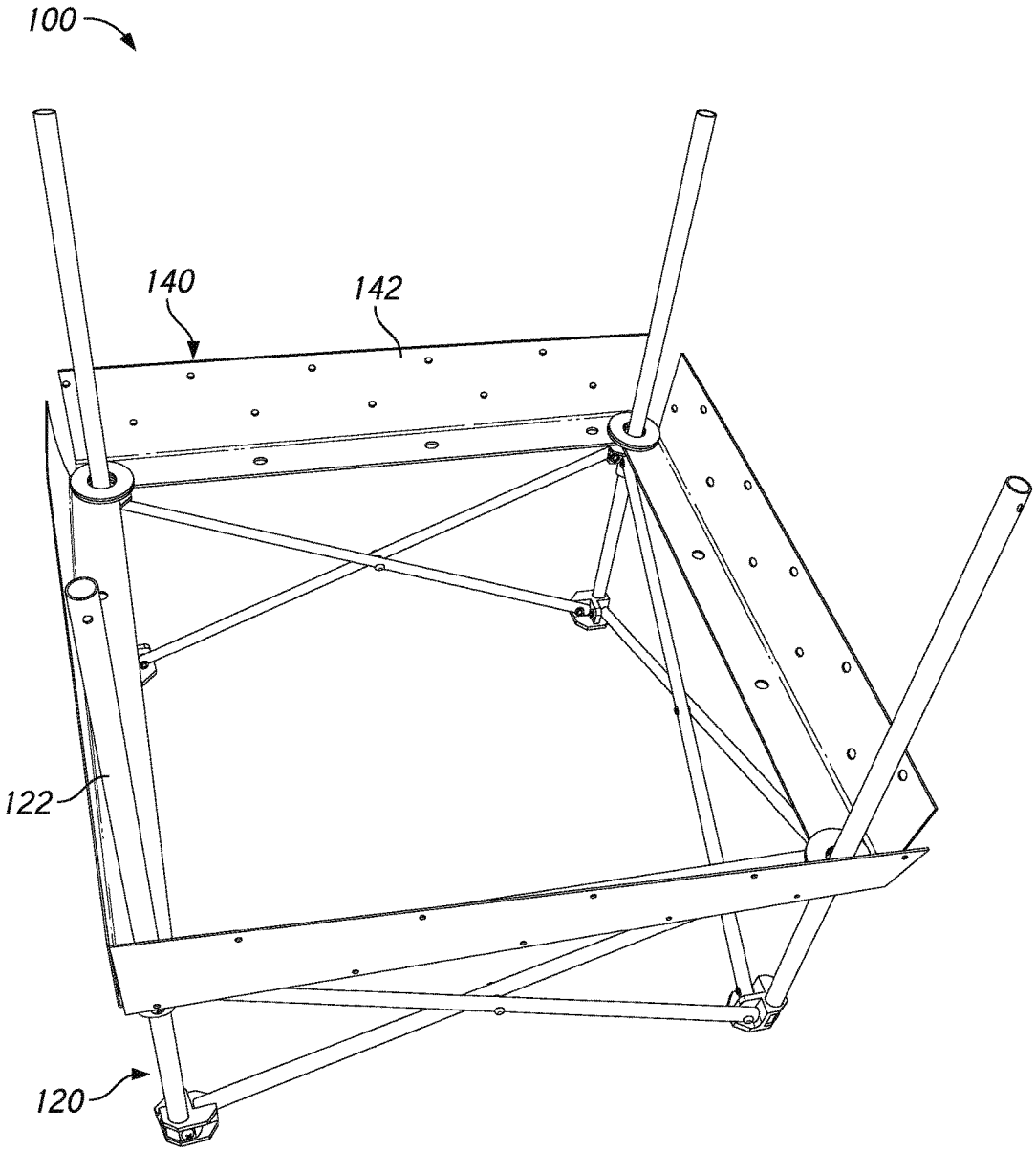
FIG. 7 is a perspective view of an embodiment of the frame and support structure of FIG. 1.

With reference next to FIG. 7, the pop-up fire pit 100 is shown in a partially assembled state with the lower portion attached to a part of the upper portion (e.g., the support structure 140 mounted to the frame 120). Individual supports 142 are slid along or past the rods 122 until they sit upon abutments or mounts (not shown). As shown in the illustrated embodiment, the number of supports 142 matches the number of vertical rods 122 and extends between each set of vertical rods 122. By attaching four supports 142 to the four rods 122, the supports 142 form a support structure 140 which extends around the periphery of the frame 120. The supports 142 can help provide a rigid framework which inhibits individual rods 122 from flexing or moving relative to other rods 122 during use, especially while a fire is burning. This beneficially enhances the structural integrity of the frame 120. Although four supports 142 are shown, it is to be understood that a fewer or greater number of supports 142 can be used. Moreover, it is to be understood that additional supports can be added. For example, the support structure 140 can include one or more supports extending diagonally across the frame 120. The diagonally extending supports may omit the upper wall 144 so that the supports do not interfere with the mesh 160.

Figure 8:
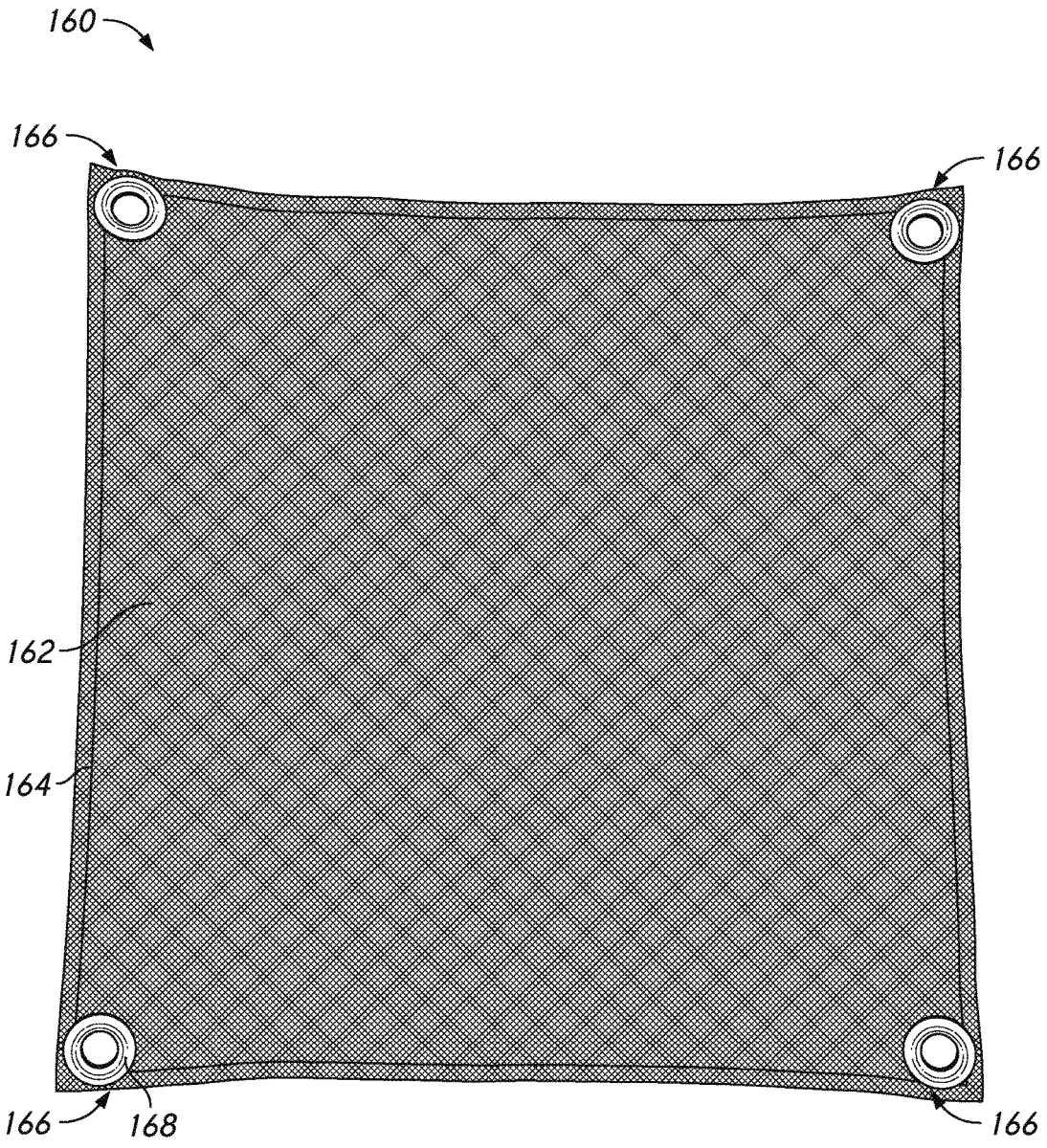
FIG. 8 is a top view of the mesh of FIG. 1.

With reference next to FIG. 8, an embodiment of a fuel support in the form of a mesh 160 is illustrated. As shown, the mesh can include a central region or base 162 which can support fuel for the fire. One or more sides of the periphery 164 of the base 162 can be reinforced, or can be made of a different material or materials than the base 162 (e.g., a more rigid or more solid material than the base 162), or can be thicker than the base 162, to resist or reduce the likelihood of tearing or sagging. The base 162 can include a plurality (e.g., at least three or at least four) mounting regions 166 with apertures 168. The spacing between the mounting regions 166 can match or correspond to the spacing of the rods 122 when the frame 120 is in the expanded configuration. In some embodiments, the mounting regions 166 can be reinforced to enhance the structural integrity of the mounting regions 166 and/or to resist tearing. For example, the mounting regions 166 can include a grommet.

Figure 9:
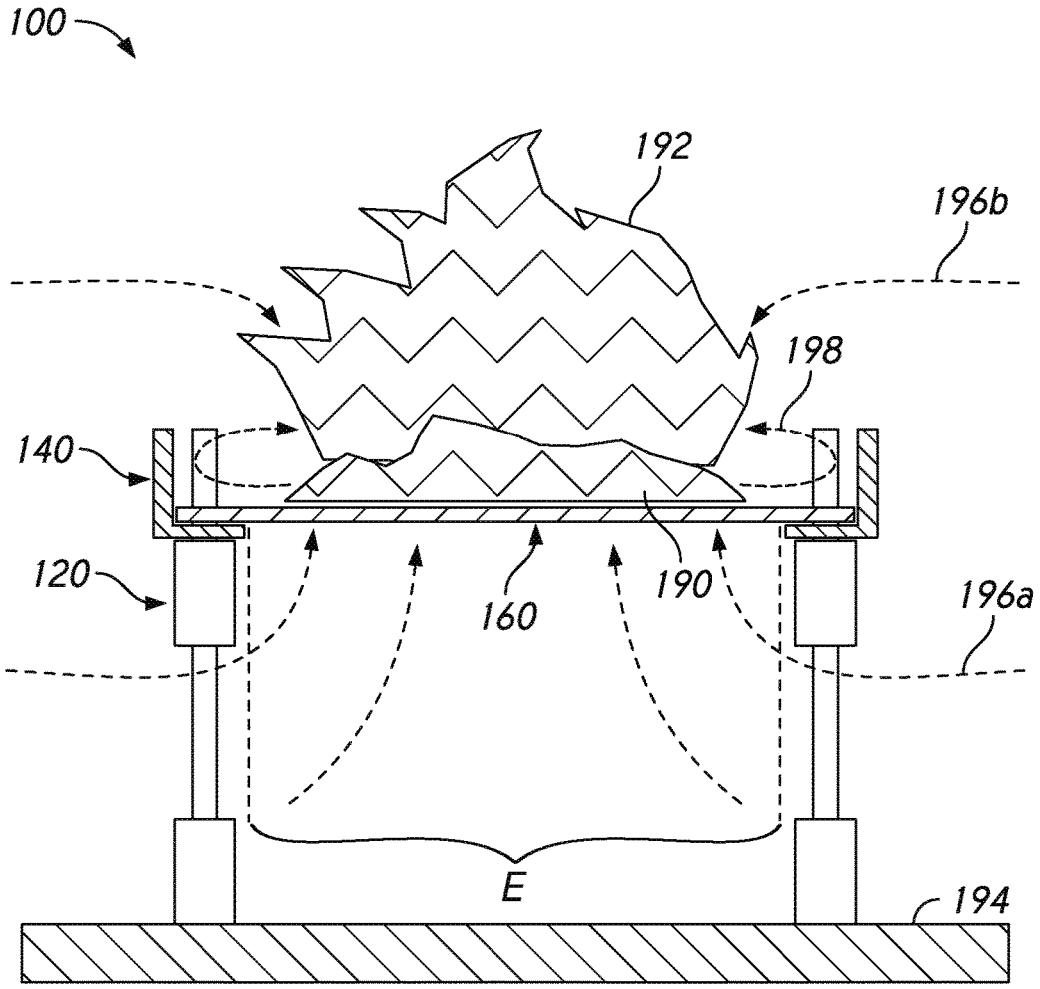
FIG. 9 is a schematic view of the fire pit of FIG. 1 with a fuel source and fire.

In some embodiments, the mesh 160 can be formed from one or more metals, such as steel (e.g., 304 stainless steel), one or more polymers, one or more composites, a combination of these materials, or other suitable materials, including one or more materials described elsewhere herein. In some embodiments, the mesh 160 can be a stainless steel woven mesh, #40, with a 010 wire size. The porosity of the mesh 160 can be chosen to allow substantial airflow through the mesh 160. In some embodiments, the mesh 160 is configured to permit unimpeded airflow to a fire throughout an entire exposed underside surface area of the mesh 160. The exposed underside surface area of the mesh 160 is the region of the underside of the mesh that is not in direct contact with the support structure 140 or frame 120 or other structure holding up or attaching the mesh to the fire pit (e.g., when the fire pit 100 is assembled). In some embodiments, as shown, the entire exposed underside surface area of the mesh 160 is in direct, unimpeded fluid communication with ambient air, laterally through the frame 120, vertically from the ground up to the exposed underside surface area of the mesh 160, and/or vertically from the heat shield 600 (see FIG. 19A) to the exposed underside surface area of the mesh 160. In some embodiments, as shown in FIGS. 9 and **19*a*, whatever structure may exist laterally (e.g., the rods 122 or the frame 120) from or underneath the mesh 160 has more or substantially more area encompassing open, free-flowing air passages than area encompassing solid or air-flow-restricting regions. In some embodiments, the closest distance from the exposed underside surface area of the mesh 160 to the substantially planar and substantially horizontal heat shield, if present, can be at least as large as about a majority of the distance from the ground or the bottom of the rods 122 of the frame 120 to the closest exposed underside surface area of the mesh 160. As illustrated in FIG. 9, the free flow of ambient air into the entire exposed underside surface of the mesh 160 is believed to enable a fire to access oxygen more readily and therefore burn fuel more thoroughly and at a higher temperature, and to permit the air currents and smoke to flow more uniformly and more evenly upwardly from the fire. In some embodiments, as shown in FIG. 9, the exposed portion of the mesh 160 that is not in direct contact with the support structure 140 or frame 120 can be illustrated by width E. The exposed portion of the mesh 160, in some instances, can comprise a larger area than the portion of the mesh 160 in direct contact with the supports 142. For example, the exposed portion of the mesh 160 may comprise at least 50% of the mesh. In some embodiments, the exposed portion of the mesh 160 comprises at least 80% (e.g., 85%, 90%, 95%, etc.) of the mesh 160 when the fire pit 100 is fully assembled. The mesh 160 being configured to provide airflow to a fuel source along a majority, or entirety, of the mesh 160** may advantageously permit for a high rate of combustion.

The porosity of the mesh can be chosen to permit airflow, while also inhibiting or preventing particulates, such as burnt embers or ash, from passing through the mesh 160 and dropping downward below the mesh. By inhibiting or preventing particulates from passing through the mesh 160, the pop-up fire pit 100 can be used in campgrounds with strict rules regarding campfire ember and ash. Such campgrounds may require that the camper retain all ember and ash for disposal at another location.

With reference next to FIG. 9, an embodiment of the fire pit 100 with a fuel source 190 and fire 192 is illustrated schematically. The fire pit 100 can beneficially maintain the fire 192 at a high burn rate as a result of the structure, arrangement, and/or orientation of the frame 120, support structure 140, and mesh 160.

Figure 19A:
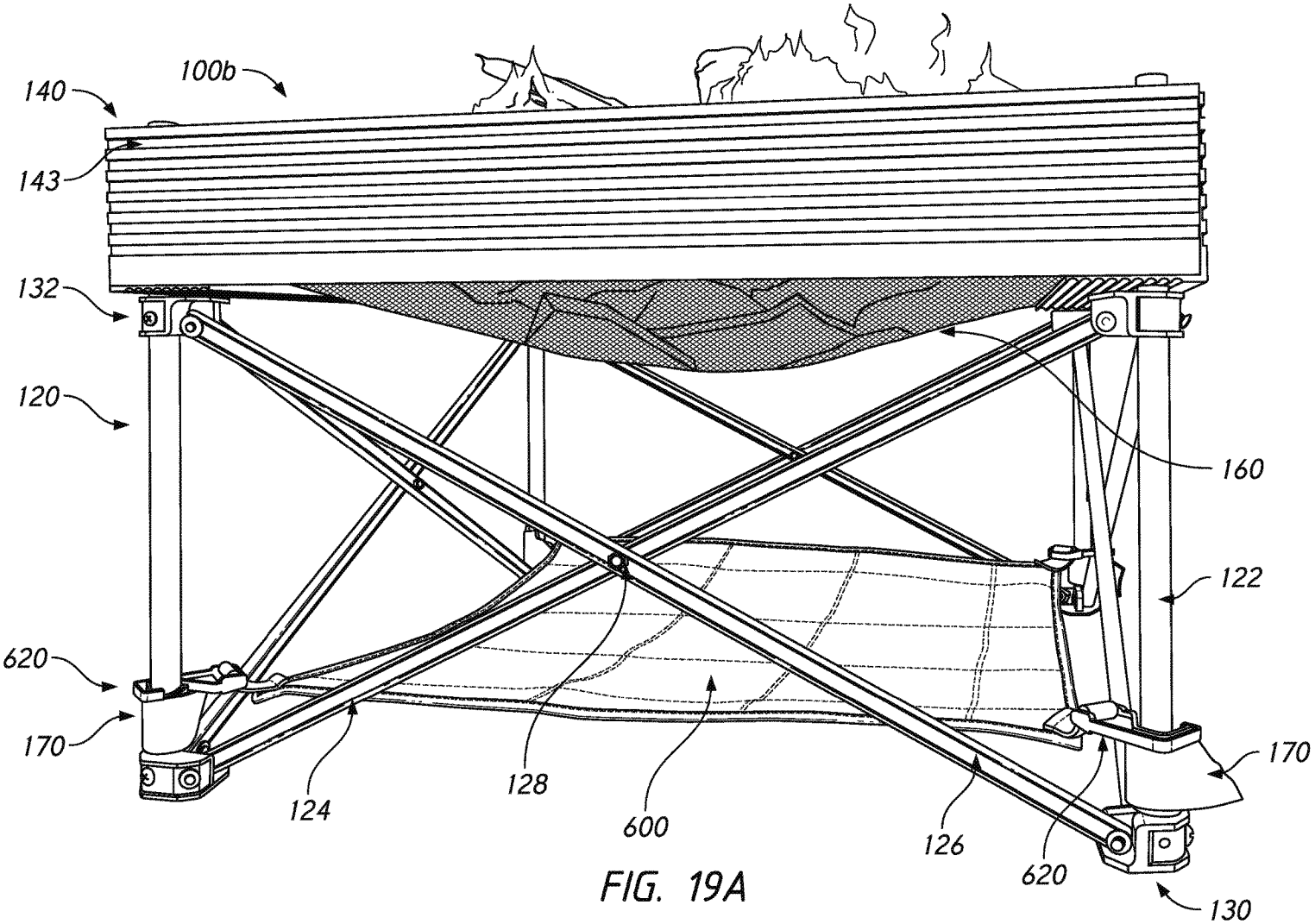
FIG. 19A is a front-oriented perspective view of an embodiment of a portable fire pit having a heat shield.

As shown, a fuel source 190, such as wood or coals, is supported by the mesh 160 above the ground surface 194. In some embodiments, the distance between the mesh 160 and the ground surface 194 can be at least about 6 inches and/or less than or equal to about 14 inches. For example, the distance between the mesh 160 when supporting the fuel source 190 and the ground surface 194 may be substantially or nearly the same or similar to the distance between the base of the support system 140 and the ground surface 194. In some embodiments, as illustrated in FIGS. 9 and 19A (for example), the mesh 160 is substantially or generally planar after assembly but before fuel is positioned on the upper surface of the mesh 160 (or in some embodiments even after fuel is positioned on the upper surface of the mesh 160). In some embodiments, a lowest surface of the mesh 160 in the assembled configuration of the fire pit 100 can be positioned higher than a majority of the vertical height of the rods 122 and/or the frame 120. In some embodiments, after assembly of the fire pit 100 but before fuel is positioned on the mesh 160, the bottom-most or lowest surface on the mesh can be positioned above or generally vertically even with the highest point where the mesh 160 contacts the structure supporting the mesh (e.g., the one or more rods 122 and/or the frame 120). By way of another example, the mesh 160 when supporting the fuel source 190 may reside entirely above the cross-bars (not shown) when the fire pit 100 is fully assembled. The location of the mesh 160 advantageously prevents any structure (e.g. the ground surface 194, frame 120, etc.) from impeded airflow to the fuel source 190. Since an airflow 196*a* passing through the frame 120 is substantially unimpeded due to the compact structure of rods 122 and cross-bars (not shown), a substantial amount of airflow 196*a* can pass through the frame 120 and the mesh 160 to support a high rate of combustion. In some embodiments, as discussed, the mesh 160 may permit airflow to the fuel source 190 through a majority, or entirety, of the mesh 160. The peripheral area below the mesh 160, such as the surface area of an outer peripheral projection of the fire pit 100 below the mesh 160, can be substantially unimpeded by components of the frame 120 and/or the support structure 140. In some embodiments, the peripheral area can be at least about 70% open, at least about 80% open, at least about 90% open, or at least about 95% open. Moreover, since the upper side of the fire pit 100 is also substantially open, a substantial amount of airflow 196*b* can reach the fire 192 further supporting a high rate of combustion.

The support structure 140, extending around a periphery of the fuel source 190, can beneficially radiate and/or reflect heat 198 back towards the fuel source. This can beneficially maintain high temperatures near the fuel source 190 to maintain higher rates of combustion. Moreover, the support structure 140 can inhibit or prevent wind from reaching the fuel source 190 and possibly reducing the rate of combustion.

Examples of Grill Grates

Figure 10:
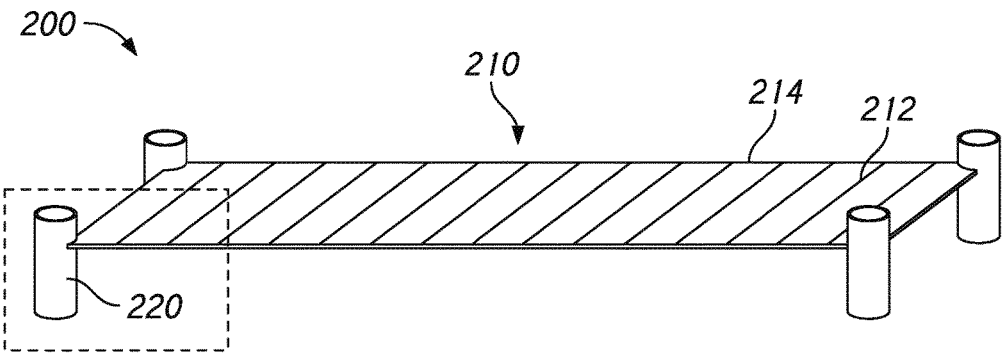
FIG. 10 is a perspective view of an embodiment of a grill grate.
Figure 11:
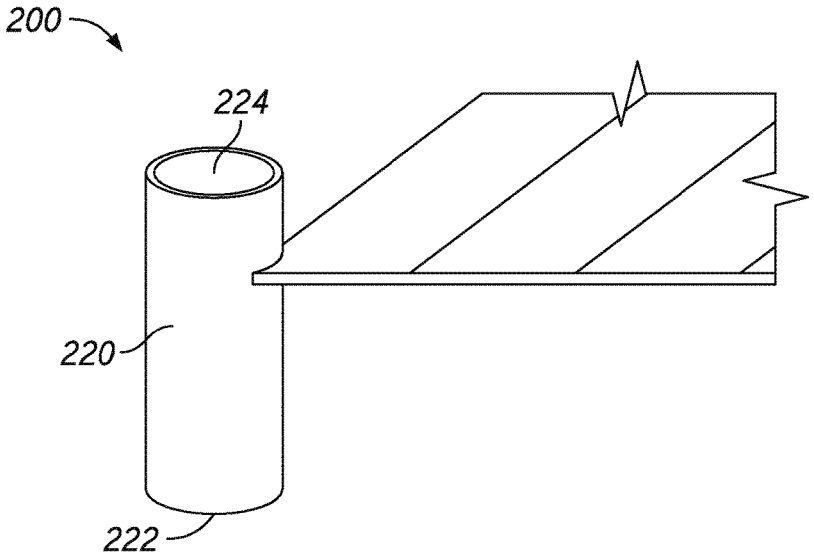
FIG. 11 is an enlarged, partial view of the grill grate of FIG. 10

FIGS. 10 and 11 are various views of a grill grate 200, according to some embodiments. In particular, FIG. 10 is a front perspective view of a grill grate 200, and FIG. 11 is an enlarged, partial view of the grill grate 200 of FIG. 10. It will be understood that the features described with reference to the grill grate 200 shown in FIGS. 10 and 11 can be used with any portable fire pit embodiment described and/or contemplated herein. For example, any one of the portable fire pits disclosed herein can be modified to function with the grill grate 200, as shown and described with reference to FIGS. 10 and 11.

The pop-up fire pit 100 can include additional components to enhance the versatility of the pop-up fire pit 100. For example, with reference to FIGS. 10 and 11, the pop-up fire pit can include a grill grate 200 for preparing food. The grill grate 200 can include a grate 210 having a plurality of bars 212, 214 forming a grilling surface. The grill grate 200 can include one or more mounts 220, such as stanchions, for coupling to the rods 122 of the frame 120. The number of mounts 220 can match the number of rods 122 of the frame 120. In some embodiments, the mounts 220 are hollow with an opening along the lower end 222 sized to receive the rods 122. The grill grate 200 can be attached to the frame 122 by aligning each of the mounts 220 with the rods 122 and sliding the mounts 220 over the rods 122.

To maintain the grill grate 200 at a desired position along the rods 122, the upper ends 224 of mounts 220 can be closed so that the upper ends 224 engage and rest upon the upper ends of the rods 122. In some embodiments, the upper ends 224 of mounts 220 can be open and the mounts 220 can include a mechanism, such as fasteners, for tightening the mounts 220 around the rod 122. It is to be understood that the pop-up fire pit 100 can include other components. For example, the pop-up fire pit 100 can include a shelf (not shown) attachable to one or more of the rods 120. In some implementations, the shelf can be used to set food, cooking utensils, or spices for cooking on the grill grate 200.

Examples of Heat Shields

Figure 18:
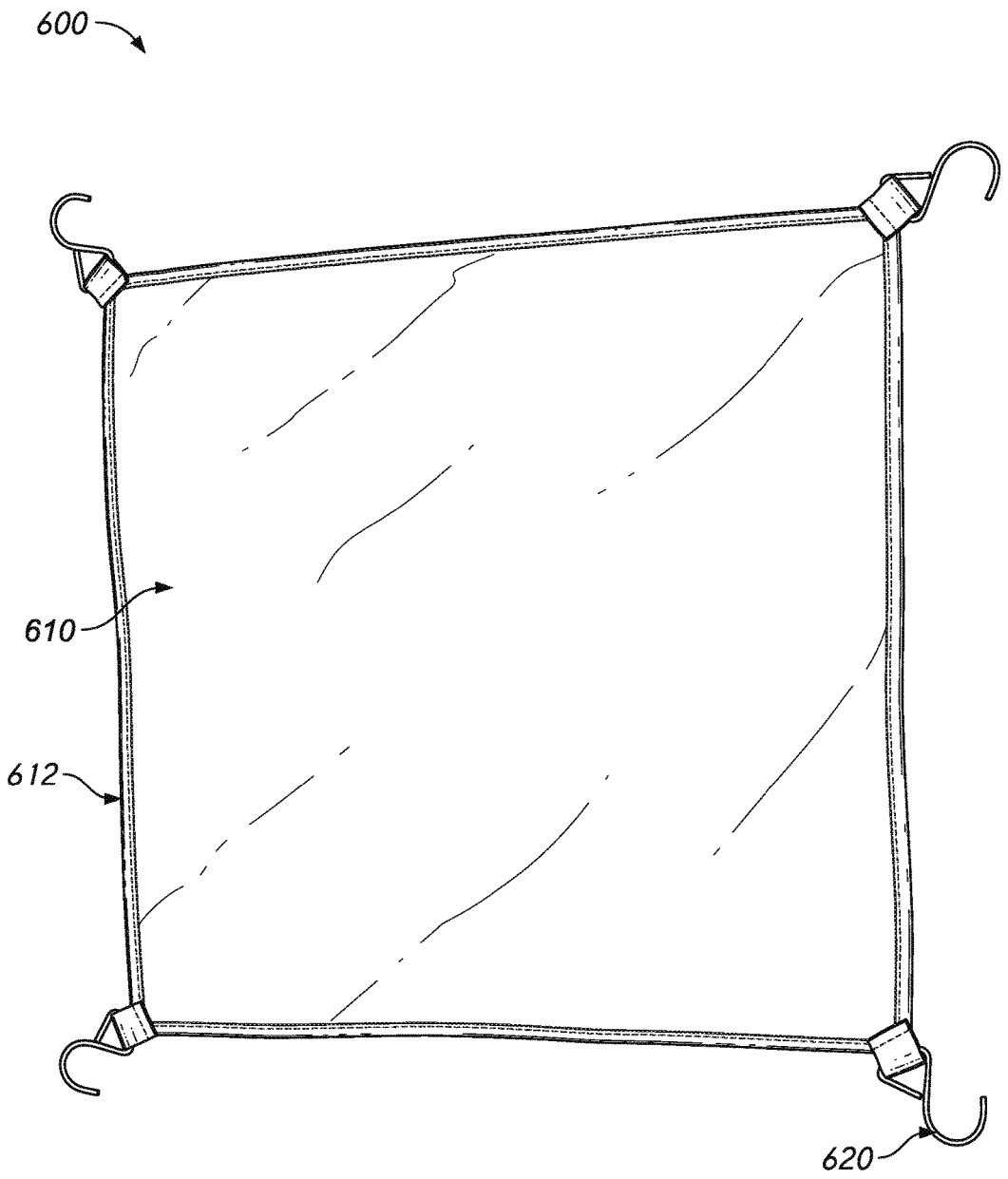
FIG. 18 is a top-oriented perspective view of an embodiment of a heat shield.
Figure 19B:
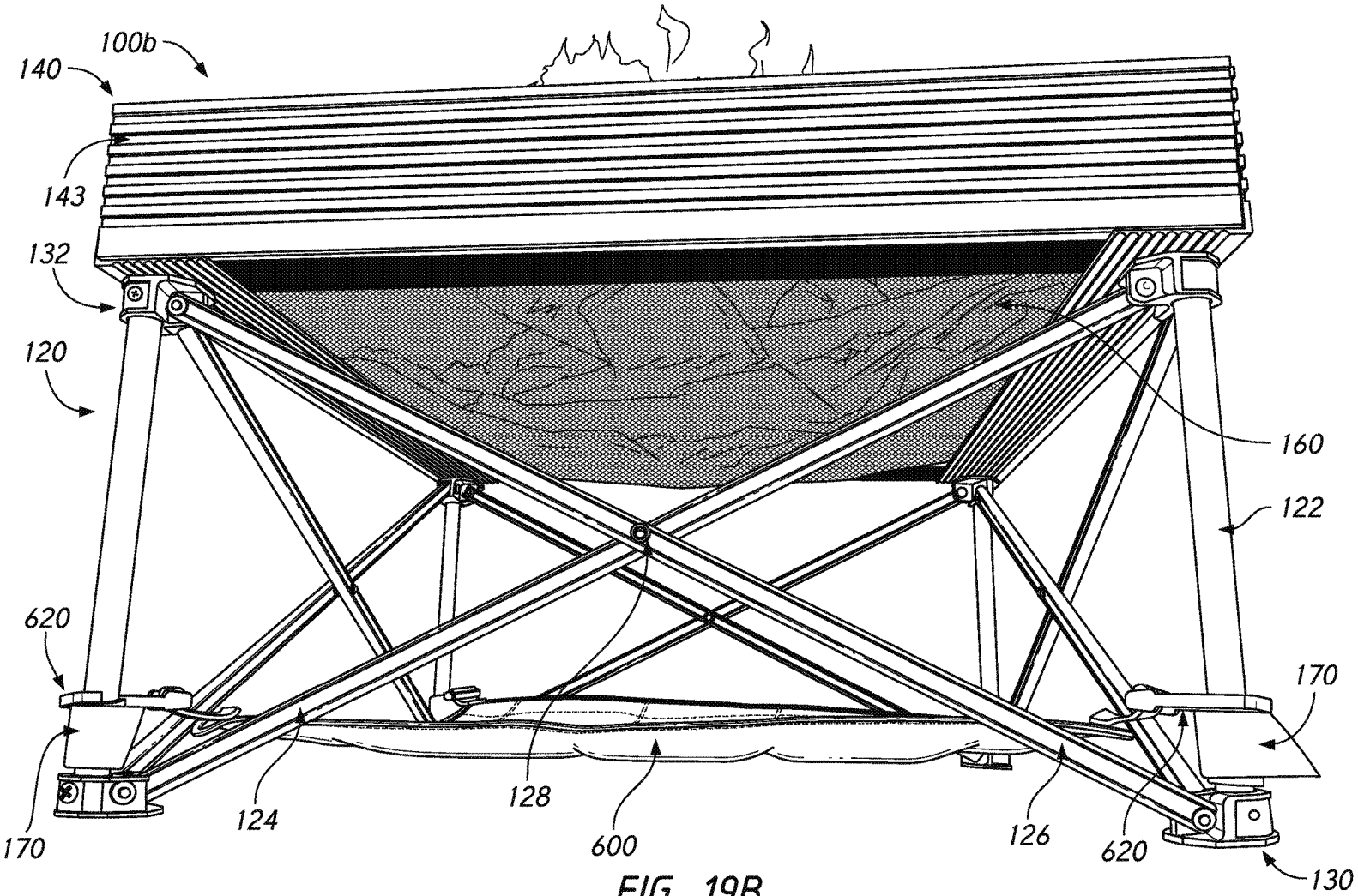
FIG. 19B is a bottom-oriented perspective view of the embodiment of a portable fire of FIG. 19A.
Figure 19C:
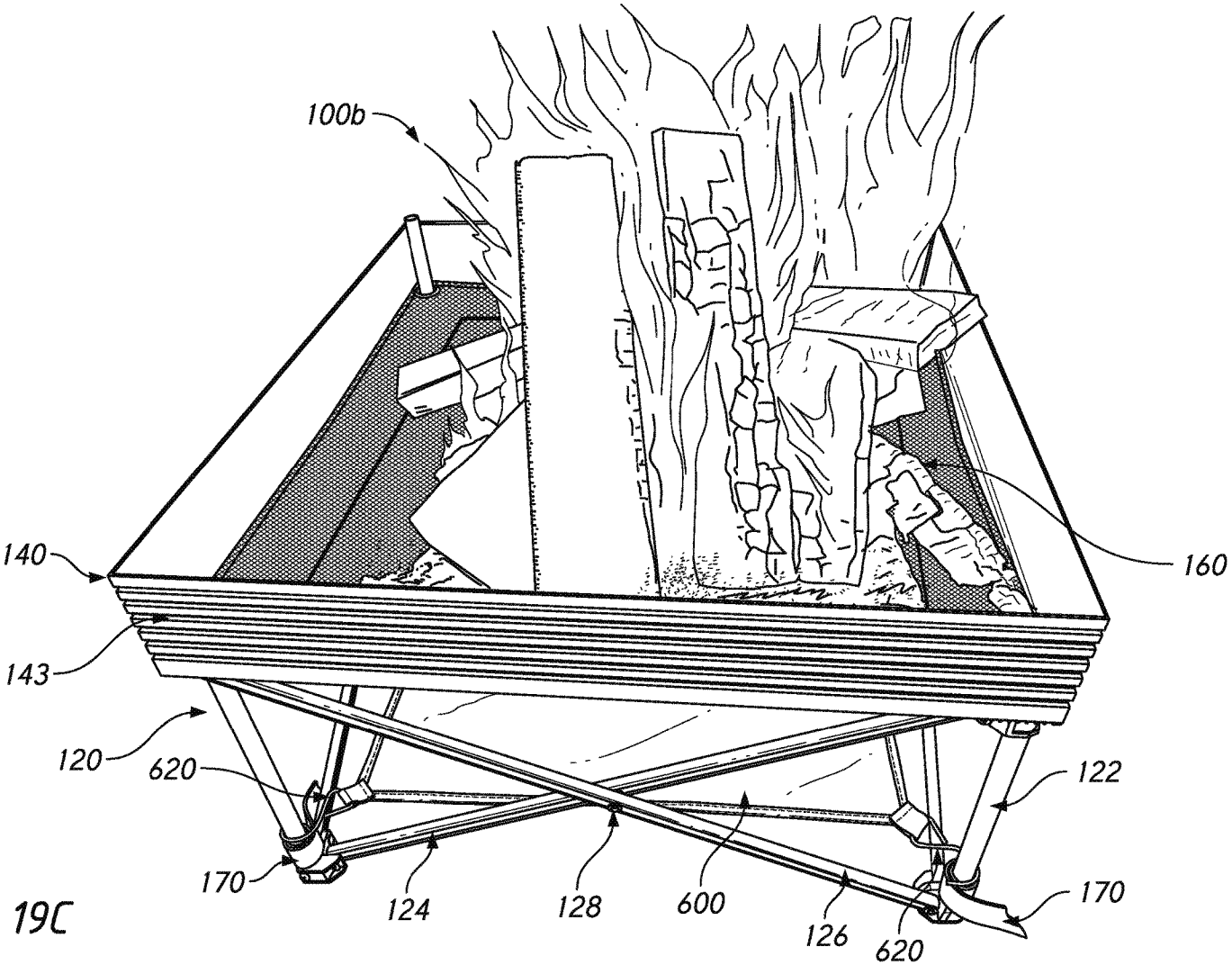
FIG. 19C is a top-oriented perspective view of the embodiment of a portable fire of FIG. 19A.

FIGS. 18-19C are various views of a heat shield 600, according to some embodiments. In particular, FIG. 18 is a top-oriented perspective view of an embodiment of a heat shield 600. FIG. 19A is a front-oriented perspective view of an embodiment of a portable fire pit 100*b* comprising a heat shield 600, and FIGS. 19B and 19C are a bottom-oriented perspective view and a top-oriented perspective view, respectively, of the portable fire pit 100*b*. Unless otherwise noted, reference numerals in FIGS. 19A-19C refer to components that are the same as or generally similar to the components in the remaining figures discussed herein. It will be understood that the features described with reference to the heat shield 600 shown in FIGS. 18-19C can be used with any portable fire pit embodiment described and/or contemplated herein. For example, any one of the portable fire pits disclosed herein can be modified to function with the heat shield 600, as shown and described with reference to FIGS. 18-19C.

With reference to FIG. 18, an embodiment of a heat shield 600 is illustrated. As shown, the heat shield 600 can include a central region or base 610. The base 610 can be configured to resist or substantially prevent the transfer of heat through the heat shield 600. As described herein and illustrated in FIGS. 19A-19C, the heat shield 600 may be placed beneath a fuel supporting region of a portable fire pit and configured to resist or substantially prevent the transfer of heat from a fire within the fuel supporting region to the ground or other supporting surface below that supports the portable fire pit. By inhibiting or preventing heat from passing through the heat shield 600, a portable fire pit including the heat shield 600 can be used in campgrounds with strict rules regarding scorching and/or burning the campground floor. Such campgrounds may require that the camper avoid the use of fire pits that may cause damage and/or affect the surrounding foliage. In some embodiments, the heat shield 600 can permit the fuel supporting region of a fire pit to be located closer to the ground as the heat shield 600 resists or prevents the transfer of heat from the fire to the ground. Providing for a lower fuel supporting region, for example, advantageously allows the fire pit to contain a lower center of gravity, and as such, increases the stability of the fire pit. By way of another example, a lower fuel supporting region can place the fire at a comfortable level for a user to provide a more comfortable experience.

In some embodiments, one or more sides of the periphery 612 of the base 610 can be reinforced, or can be made of a different material or materials than the base 610 (e.g., a more rigid or more solid material than the base 162), or can be thicker than the base 610, to resist or reduce the likelihood of tearing or sagging.

The heat shield 600 can include a plurality (e.g., at least three or at least four) mounting components 620. The mounting components 620 can be utilized to attach the heat shield 600 to one or more portions (e.g., the vertical rods, cross-bars, and/or pivot) of any portable fire pit disclosed herein. For example, the mounting components 620 may comprise one or more attachment devices, such as hooks (as shown in FIG. 18) that are sized to engage at least a portion of a support structure of a portable fire pit. The hooks, in some instances, may be affixed to various portions of the heat shield 600 through various means (e.g., one or more adhesives and/or straps). A spacing between the mounting components 620 can match or correspond to the spacing of vertical rods 122 and/or cross-bars 124, 126 of a frame 120 in the expanded configuration. In some embodiments, the mounting components 620 can be reinforced to enhance the structural integrity of the mounting components 620 and/or to resist tearing.

The heat shield 600 can be formed from any suitable non-flammable and/or insulation material configured to resist or prevent substantial heat flow through the heat shield 600. With reference to FIGS. 19A-19C, the base 610 can be designed to be positioned underneath a fuel supporting region of a portable fire pit, as described herein. At least a portion of the base 610 can be formed from one or more materials which are generally heat resistant and/or insulating. For example, as shown in the illustrated embodiment of FIGS. 19A-19C, a top side of the base 610 is intended to be positioned under a fire, and a bottom side of the base 610 faces in the opposite direction from the top side and is intended to be positioned below the fire but facing away from the fire. At least the top side of the base 610 extending below a fuel source and/or fire, can beneficially radiate and/or reflect heat back towards the fuel source and/or radially outwardly in a direction away from the ground floor. This can beneficially maintain high temperatures near the fuel source 190 to maintain higher rates of combustion. Moreover, the heat shield 600 can inhibit or prevent excessive heat from reaching the ground floor and possibly scorching a campground floor.

The bottom side and/or the top side of the base 610 can be formed from a generally heat or thermally resistant material. For example, either or both of the bottom side and the top can be made of material(s) and/or formed in such a way that they will not melt or burn or emit appreciable amounts of vapor or smoke (especially harmful types of vapor or smoke) when exposed to temperatures within the range normally encountered in a standard fire used for human warmth and/or cooking, such as a wood-burning fire.

In some embodiments, the base 610 is a composite made of two or more materials. Since the top side will generally encounter much higher temperatures than the bottom side, the top side can have a higher heat reflectivity than the bottom side. For example, in some embodiments, the top side can be made of material(s) and/or formed in such a way that its heat reflectivity is sufficient to reflect a majority of the heat energy emitted downward from a burning fire on the fuel support, and/or not to melt or burn or emit appreciable amounts of vapor or smoke when exposed to temperatures within the range normally encountered in a standard fire used for human warmth and/or cooking, while the bottom side can be made of different material(s) and/or formed in such a way that its heat conductivity is lower than the heat conductivity of the top side, and/or not to melt or burn or emit appreciable amounts of vapor or smoke when exposed to the heat transmitted from the lower face of the top side to the upper face of the bottom side (where the top side and the bottom side interface) when the top side is exposed to such a fire. In some instances, the base 610 may comprise a combination of a thermally resistant polymer and/or a silica-based material, and a metal. For example, the bottom side can be composed of fiberglass or silicone and the top side can comprise an aluminum coating.

In some embodiments, both the bottom and top sides can be made of material(s) and/or formed in such a way that heat conductivity of the combined materials is very low. For example, in the bottom side and/or the top side, when a particular region of the base 610 encounters a high temperature, it can resist transferring such high temperature laterally to adjacent portions of the base 610 and/or it can resist transferring such high temperature from a top face to a bottom face. For example, in some embodiments, the temperature of a lateral region and/or a bottom face that is adjacent to the top face (e.g. when the top face is closer to or closest to a fire) can be less than or equal to about three-quarters or less than or equal to about one-half of the temperature of the top face.

While certain materials have been described in connection with the heat shield 600, it is to be understood that the components of any heat shield may be formed of any of many different types of materials or combinations. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

As illustrated in FIGS. 19A-19C, the heat shield 600 may be configured to attach to the portable fire pit 100*b* through use of the selectively detachable mounting components 620. The mounting components 620 may be configured to engage various portions of the frame 120 to be positioned below a fire. For example, the mounting components 620 can be mounted along the rods 122. As shown, each of the mounting components 620 is removably coupled to a corresponding rod 122. By mounting the heat shield 600 to the rods 122, the heat shield 600 would be mounted near the ground surface thereby enhancing the overall prevention of heat transfer to the floor. As shown, the mounting components 620 can be slideable relative to the rods 122 to adjust the height of the heat shield 600 relative to the ground floor and the fire. This can allow a user to determine the optimum height of the heat shield 600 based on the size and location of the fire. While the mounting components 620 are illustrated as engaging the rods 122, it will be understood by one having skill in the art that the mounting components 620 and heat shield 600 may be configured to engage any other portion of the frame 120 (e.g., the crossbars 124, 126 and/or pivot 128). As shown in FIG. 19A, in some embodiments, one or more of the crossbars 124, 126 and/or one or more of the rods 122 can be affixed or attached to each other or configured to rotatably pivot or connect to each other with one or more flat surfaces of such components in contact with each other, providing a stable connection.

The portable fire pit 100*b*, in some embodiments, can include one or more stops 170 which limit the position of the heat shield 600. The mounting components 620 may rest upon the stops 170 to prevent the heat shield 600 from sliding down along the rods 122. The stops 170 can be positioned such that, in the expanded configuration, the heat shield 600 is positioned between about 1 to about 6 inches from the ground floor. In some embodiments, the stops 170 can be formed from a metal, such as stainless steel or aluminum, and/or a polymer, such as a plastic or nylon; however, it is to be understood that these components can be formed from other types of materials as noted herein. The stops 170 can be oriented to slide in a non-vertical direction. This may permit a user to adjust the height of the heat shield 600. Although the stops 170 are shown as slideable vertically along the rods 122, it is to be understood that other configurations can be utilized. For example, the stops 170 can be positioned on other structures of the frame 120 such as cross-bars 124, 126.

As shown and described, the heat shield 600 is supported above the ground floor or other supporting surface. In some embodiments, the distance between the heat shield 600 and the ground floor can be at least about 1 inch and/or less than or equal to about 6 inches. The heat shield 600 can be sized and configured not to substantially impede airflow passing underneath the frame 120. For example, the heat shield 600 can be positioned at least about 4 inches or at least about 6 inches below the fuel support, and/or positioned vertically further from the fuel support than a majority of the distance from the fuel support to the ground floor or other supporting surface. Accordingly, the heat shield 600 may permit substantial air flow to the fuel supporting region and provide for proper support a high rate of combustion.

Examples of Ember Containment Systems

Figure 12:
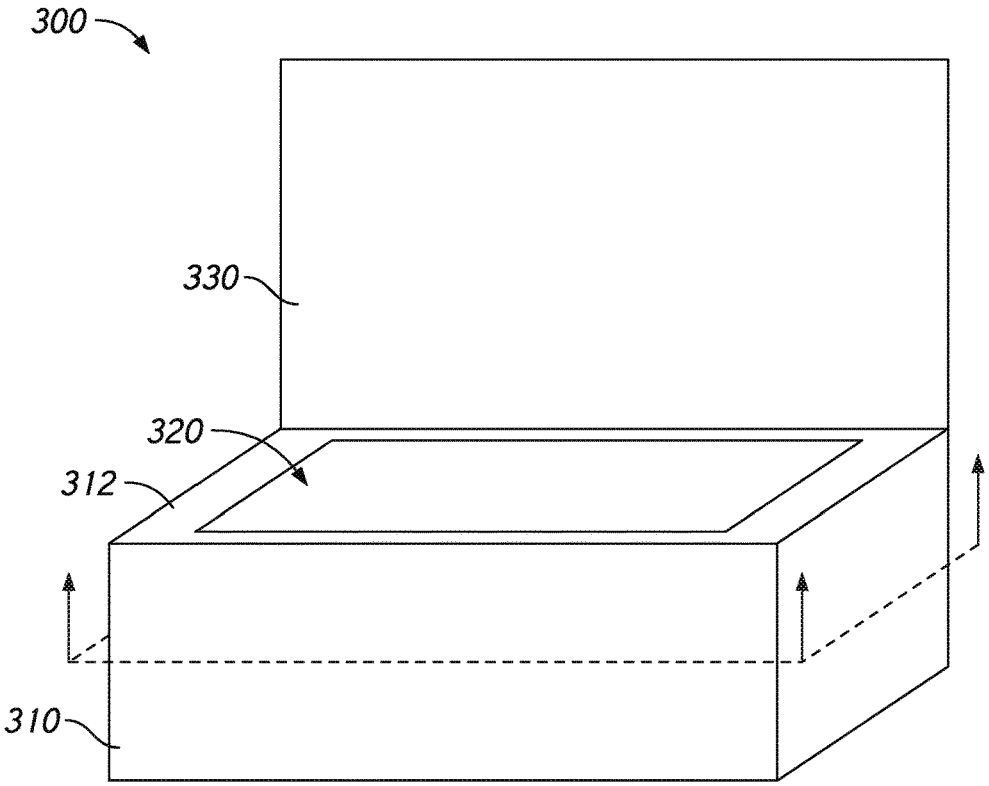
FIG. 12 is a perspective view of an embodiment of an ember containment system.
Figure 13:
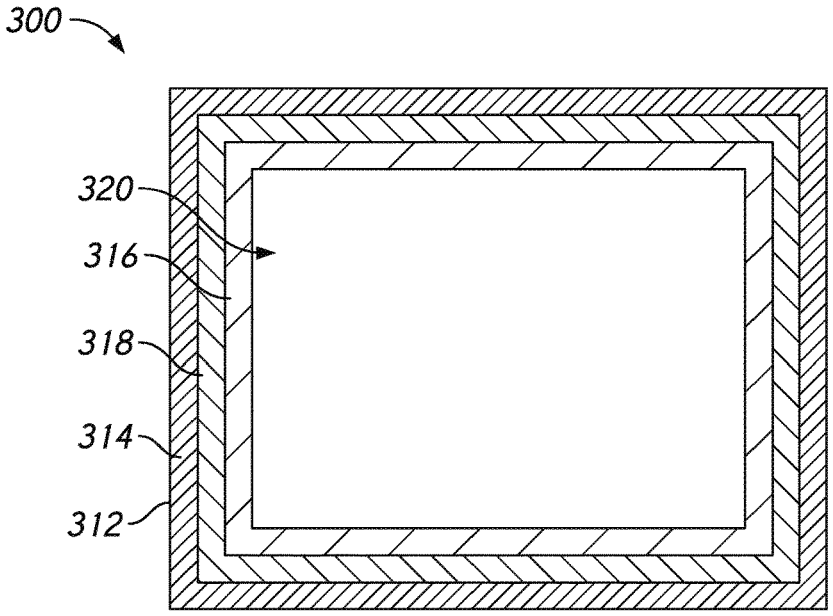
FIG. 13 is a cross-sectional view of the ember containment system of FIG. 12

With reference next to FIGS. 12 and 13, an embodiment of an ember containment system 300 is illustrated. The ember containment system 300 can include a body 310 having a plurality of walls 312 defining a cavity 320 in which materials, such as embers from the fire pit 100, can be stored. The ember containment system 300 can include a lid 330 to prevent the materials contained therein from escaping from the system 300 during transport. In the illustrated embodiment, the lid 330 can be hinged to one of the walls 312 of the body 310; however, it is to be understood that the lid 330 can be wholly separate from the body 310.

One or more of the walls 312 defining the cavity 320 can have a multi-layer construction to reduce transmission of heat from the cavity 320. As shown, in some embodiments, the walls 312 can include an outer layer 314, an inner layer 316, and an intermediate layer 318. The outer layer 314 can be formed from materials which enhance the structural rigidity of the ember containment system 300. The inner layer 316 can be formed from materials which can withstand high temperatures—in some instances greater than 800° F. or more. In some embodiments, the outer layer 314 and/or the inner layer 316 can be formed from one or more metals, such as steel or aluminum, one or more polymers, one or more composites, a combination of these materials, or other suitable materials, including one or more materials described elsewhere herein. The intermediate layer 318 can be formed from materials which can inhibit transmission of heat from the inner layer 316 to the outer layer 314. In some embodiments, the intermediate layer 318 can be formed from materials such as ceramics, fiberglass, a combination of these materials, or other suitable materials, including one or more materials described elsewhere herein. It is to be understood that the lid 330 can have a similar construction to that of the walls 312.

The ember containment system 300 can retain recently burned embers to allow the embers to sufficiently cool before being discarded. This can be particularly useful in situations—such as camping in "leave no trace" campgrounds, tailgating, and/or ice fishing—where a user must retain hot embers shortly after burning and therefore cannot dispose of the hot embers in on-site disposal facilities. In some embodiments, the ember containment system 300 can have a compact form factor to facilitate storage and transport on a user's person. The ember containment system 300 can be sized to generally match the size of the pop-up fire pit 100. For example, a width of at least one wall 312 of the ember containment system 300 can be the same as, or generally similar to, the width $W_E$ of the pop-up fire pit 100. This can allow a user to tip the pop-up fire pit 100 over into the ember containment system 300.

Figure 16:
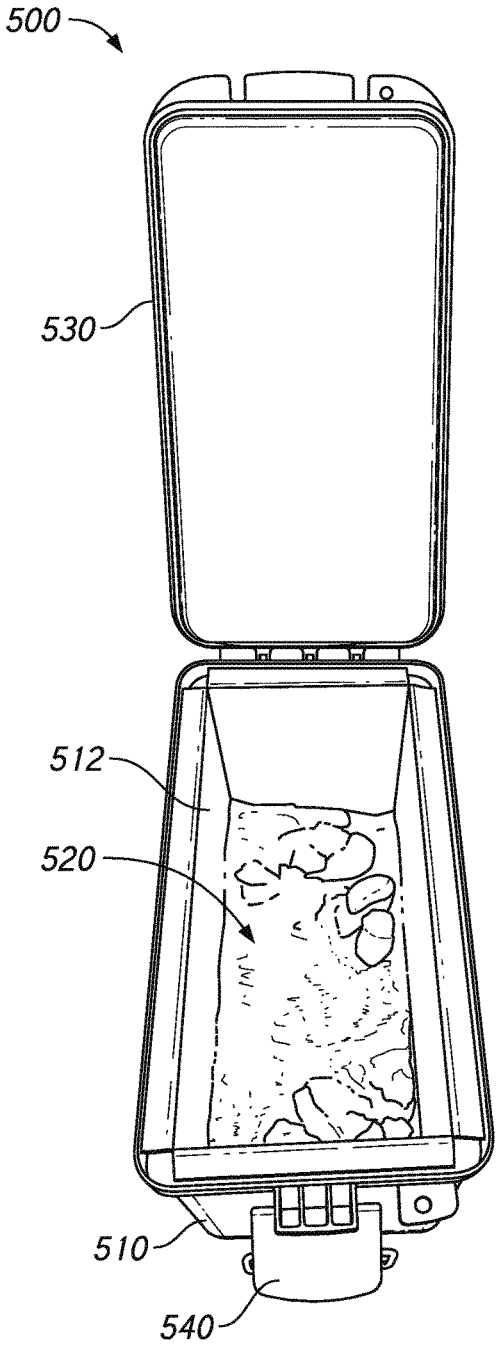
FIG. 16 is a top-oriented perspective view of an embodiment of an ember containment system with a lid being in an open position.
Figure 17:
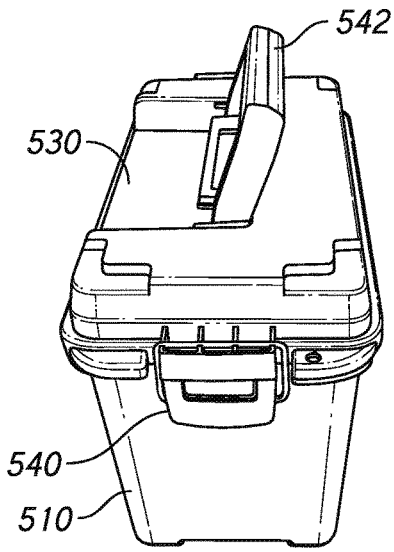
FIG. 17 is a top-oriented perspective view of the ember containment system of FIG. 16, the lid being in a closed position.

With reference next to FIGS. 16 and 17, another embodiment of an ember containment system 500 is illustrated. The ember containment system 500 can include similarities to ember containment system 300 and therefore it is to be understood that any feature and/or structure described in connection with system 300 can be applied to system 500. As shown, the ember containment system 500 can include a body 510 having a plurality of walls 512 defining a cavity 520. The ember containment system 500 can include a lid 530 rotatably coupled to the body 510. The lid 530 can maintained in a closed position via a latch mechanism 540. The lid 530 can include a handle 542 to facilitate transporting the system 500.

As shown, the ember containment system 500 can include an inner lining 512 within the cavity 520. The inner lining 512 can be removable to facilitate disposal of materials, such as ember, contained within the cavity 520. In some embodiments, the inner lining 512 can be formed from a metal mesh, such as stainless steel; however, it is to be understood that any other suitable material described herein can be used.

Examples of Methods of Assembling and Using a Fire Pit

Figure 14:
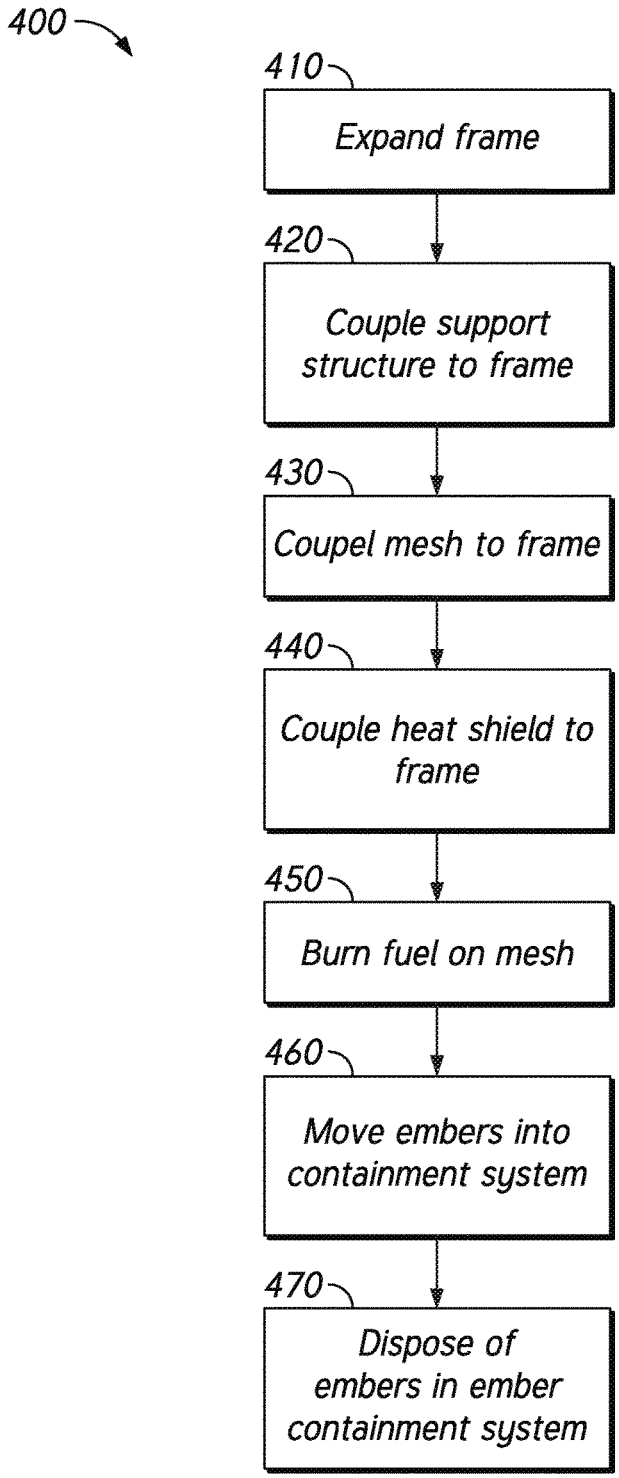
FIG. 14 is an embodiment of a method of assembling and using a fire pit and an ember containment system.

With reference next to FIG. 14, an embodiment of a method 400 of assembling and using one or more of the pop-up fire pit 100, 100*a*, the heat shield 600, and the ember containment system 300, 500 is illustrated. At step 410, a frame of the pop-up fire pit 100, 100*a* can be expanded from an initial, collapsed configuration. At step 420, a support structure can be coupled to the frame. In embodiments where the support structure includes a plurality of supports similar to supports 142, each of the supports can be individually coupled to frame by aligning mounting regions with the frame. For example, the mounting regions can be aligned with, and slid down, upwardly extending rods of the frame. At step 430, a mesh can be coupled to the frame. In embodiments where the mesh includes mounting regions similar to mesh 160, the mesh can be coupled to frame by aligning mounting regions with the frame. For example, the mounting regions of the mesh can be aligned with, and slid down, upwardly extending rods of the frame. At step 440, a heat shield can be coupled to the frame. In embodiments where the heat shield includes mounting components similar to heat shield 600, the heat shield 600 can be coupled to frame by attaching mounting components 620 to the frame. For example, the mounting components of the heat shield can be attached to, and slid along the rods of the frame to adjust the height of the heat shield. At step 450, fuel can be placed atop the mesh and burned. At step 460, the spent fuel or embers can be moved into the ember containment system 300, 500. In some embodiments, this can be achieved by grabbing a lower end of the pop-up fire pit 100 and tilting the pop-up fire pit 100, 100*a* to expel the embers from the mesh and into the containment system. After the embers have been expelled from the pop-up fire pit 100, 100*a* the pop-up fire pit 100 can be disassembled by reversing steps 410, 420, 430, and 440. At step 470, the spent fuel or embers can be moved from the ember containment system 300, 500. In embodiments having a removable inner lining, such as system 500, this step can be performed by removing the inner lining from the system.

Although this disclosure describes certain embodiments, it will be understood by those skilled in the art that many aspects of the methods and devices shown and described in the present disclosure may be differently combined and/or modified to form still further embodiments or acceptable examples. All such modifications and variations are intended to be included herein within the scope of this disclosure. Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Other Variations

While certain materials have been described in connection with pop-up fire pit 100, it is to be understood that the components defining any pop-up fire pit may be formed of any of many different types of materials or combinations. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any pop-up fire pit 100 may be purchased pre-manufactured or manufactured separately and then assembled together. However, any or all of the components may be manufactured simultaneously and integrally joined with one another. While certain methods of manufacture have been described in connection with pop-up fire pit 100, it is to be understood that manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While certain embodiments have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope of the disclosure. Accordingly, the scope of the present disclosure is defined only by reference to the claims presented herein or as presented in the future.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result, such as a desired function or result described in connection with the category of such value, amount, or characteristic.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

The following is claimed:

1. A portable fire pit configured to support a fire fuel source and a fire at a location elevated above a ground surface such that an area directly below the fire fuel source is unobstructed so as to permit airflow to the fire fuel source from a location directly below the fire fuel source, the portable fire pit comprising:

a frame comprising a plurality of upwardly extending rods and a plurality of cross-bars, the frame being configured to transition between a collapsed configuration and an expanded configuration, wherein the frame further comprises a plurality of side regions with an area vertically surrounded by the plurality of upwardly extending rods when the frame is in the expanded configuration, and wherein a majority of the area of each of the plurality of side regions is unimpeded and open to airflow;

a support structure extending around a periphery of the frame, the support structure comprising a plurality of separable supports, each support having an upper wall, a base, and one or more support apertures each sized to receive at least one of the upwardly extending rods; and a mesh configured to support a fire fuel source, the mesh being configured to be positioned above the cross-bars when the frame is in the expanded configuration, the mesh comprising a base and one or more mesh apertures each sized to receive at least one of the upwardly extending rods such that each of the upwardly extending rods is capable of extending upwardly through the mesh, wherein a porosity of the mesh is configured to inhibit particulates generated by a fire from passing downwardly through the mesh, wherein, when the portable fire pit is assembled, a majority of vertical distance between the mesh and a ground surface is unimpeded and open to airflow such that air is permitted to pass from below the mesh, through the mesh, and to the fire above the mesh, wherein, when the portable fire pit is assembled, the base of the mesh comprises a support contact portion having a support contact area and an exposed portion having an exposed area larger than the support contact area, wherein the support contact area extends around a perimeter of the mesh, and wherein the exposed portion of the mesh is in direct, unimpeded communication with an ambient air below the mesh and is configured to permit airflow to the fire fuel source through at least a majority of the exposed portion, and wherein the frame, the support structure, and the mesh are configured to be stored and transported by a user as separate components and then assembled by a user into the portable fire pit without tools.

2. The portable fire pit of claim 1, wherein the plurality of cross-bars extend between at least two of the plurality of upwardly extending rods.

3. The portable fire pit of claim 1, wherein each of the plurality of upwardly extending rods comprises an outer rod and an inner rod, wherein the inner rod is slidably disposed at least partially within the outer rod.

4. The portable fire pit of claim 1, wherein the support structure further comprises one or more heat dissipation elements.

5. The portable fire pit of claim 4, wherein the heat dissipation elements comprises at least one aperture configured to provide air flow to the fire fuel source.

6. The portable fire pit of claim 4, wherein the heat dissipation elements comprises at least one channel in the upper wall, wherein the at least one channel is configured to increase an external surface area of the upper wall.

7. The portable fire pit of claim 1, wherein the mesh is configured to inhibit ash from passing through the mesh.

8. The portable fire pit of claim 1, wherein each of the one or more mesh apertures of the mesh comprises a grommet.

9. The portable fire pit of claim 1 further comprising a grill grate.

10. The portable fire pit of claim 9, wherein the grill grate comprises one or more mounts configured to couple to at least one of the plurality of upwardly extending rods.

11. The portable fire pit of claim 10, wherein each of the one or more mounts comprises a fastener to couple the mount to at least one of the plurality of upwardly extending rod.

12. The portable fire pit of claim 1 further comprising a heat shield configured to resist transfer of heat through the heat shield.

13. The portable fire pit of claim 12, wherein the heat shield comprises a plurality of mounting components configured to engage at least a portion of the frame.

14. A combination of the portable fire pit of claim 1 and a sleeve, wherein the portable fire pit is configured to be stored within the sleeve when the portable fire pit is in the collapsed configuration.

15. A combination of the portable fire pit of claim 1 and an ember containment system, wherein the ember containment system is configured to retain the fire fuel source after use.

16. A method of enabling the assembly of a portable fire pit configured to support a fire fuel source and a fire at a location sufficiently elevated above a ground surface such that an area directly below the fire fuel source is unobstructed so as to permit airflow to the fire fuel source from a location directly below the fire fuel source, the method comprising:

providing a frame having a collapsed configuration and an expanded configuration, the frame comprising:

a plurality of rods, a plurality of cross-bars, and a plurality of side regions with an area vertically surrounded by the plurality of rods when the frame is in the expanded configuration, a majority of the area of each of the plurality of side regions being unimpeded and open to airflow;

providing a plurality of support structures each comprising one or more support apertures configured to slidably engage with at least one of the plurality of rods to removably couple the support structure to the frame when the frame is in the expanded configuration; and providing a mesh comprising one or more mesh apertures configured to slidably engage at least one of the plurality of rods to permit each of the plurality of rods to extend upwardly through the mesh and to removably couple the mesh to the frame when the frame is in the expanded configuration, the mesh being configured to be positioned above the cross-bars when the frame is in the expanded configuration, the mesh being further configured to retain a fire fuel source, the mesh further comprising a porosity configured to permit airflow to the fire fuel source and to inhibit particulates generated by a fire from passing downwardly through the mesh, the mesh further comprising a frame contact portion and an exposed base in direct unimpeded communication with an ambient air, the exposed base being configured to permit airflow to the fire fuel source through at least a majority of the exposed base, the frame contact portion extending around a perimeter of the mesh, wherein the exposed base is larger than the frame contact portion, and wherein, when the portable fire pit is assembled, a majority of vertical distance between the mesh and a ground surface is unimpeded and open to airflow such that air is permitted pass from directly below the mesh, through the mesh, and to the fire above the mesh.

17. The method of claim 16 further comprising providing a heat shield configured to resist transfer of heat through the heat shield, wherein the heat shield is configured to removably attach to at least a portion of the frame.

18. The method of claim 16 further comprising providing a sleeve configured to store one or more of the frame, the plurality of support structures, and the mesh within the sleeve when the frame is in the collapsed configuration.

* * * * *